US011697439B2

(12) United States Patent
Morin

(10) Patent No.: US 11,697,439 B2
(45) Date of Patent: Jul. 11, 2023

(54) UNDERSLUNG STEERING ARM ASSEMBLY

(71) Applicant: Transportation IP Holdings, LLC, Norwalk, CT (US)

(72) Inventor: Andrew J. Morin, Rosemont, IL (US)

(73) Assignee: Transportation IP Holdings, LLC, Norwalk, CT (US)

( * ) Notice: Subject to any disclaimer, the term of this patent is extended or adjusted under 35 U.S.C. 154(b) by 234 days.

(21) Appl. No.: 17/133,343

(22) Filed: Dec. 23, 2020

(65) Prior Publication Data

US 2021/0139056 A1 May 13, 2021

Related U.S. Application Data

(60) Provisional application No. 62/934,129, filed on Nov. 12, 2019.

(51) Int. Cl.
*B61F 5/38* (2006.01)
*B61F 5/52* (2006.01)

(52) U.S. Cl.
CPC ..... *B61F 5/38* (2013.01); *B61F 5/52* (2013.01)

(58) Field of Classification Search
CPC ..... B61F 5/00; B61F 5/38; B61F 5/40; B61F 5/44; B61F 5/46; B61F 5/52
See application file for complete search history.

(56) References Cited

U.S. PATENT DOCUMENTS 4,823,706 A * 4/1989 McSweeney ..... B61F 5/38 105/165
5,263,420 A * 11/1993 Schwendt ..... B61F 5/38 105/166
5,666,885 A * 9/1997 Wike ..... B61F 5/36 105/168
5,909,711 A * 6/1999 Vogel ..... B61F 5/38 105/167
2002/0098034 A1* 7/2002 Conaway ..... B61F 5/38 403/57

* cited by examiner

*Primary Examiner* — Mark T Le
(74) *Attorney, Agent, or Firm* — McCoy Russell LLP

(57) ABSTRACT

A car truck including a first side frame, a second side frame, and an underslung steering assembly connected to the first side frame and the second side frame, configured to reduce, inhibit, minimize, and/or prevent truck hunting and warping.

17 Claims, 18 Drawing Sheets

UNDERSLUNG STEERING ARM ASSEMBLY

CROSS-REFERENCE TO RELATED APPLICATION

The present application claims priority to U.S. Provisional Patent Application No. 62/934,129, entitled, "UNDERSLUNG STEERING ARM ASSEMBLY" and filed Nov. 12, 2019. The entire contents of the above-referenced application is hereby incorporated by reference for all purposes.

BACKGROUND

Certain vehicles (such as freight railroad cars) include a car body and two spaced apart trucks. The car body or car body under frame includes two spaced apart center plates that respectively rest on and are rotatably or swivelly received by bolster bowls of the two trucks. The trucks rollingly support the car body along a path (such as along railroad tracks). Each truck has a three piece truck configuration that includes two spaced apart parallel side frames and a bolster. The side frames extend in the same direction (such as in the direction of the tracks), and the bolster extends transversely or laterally (such as perpendicularly to the tracks). The bolster extends laterally through and between and is supported by the two spaced apart side frames. Each side frame defines a center opening and pedestal jaw openings on each side of the center opening. Each end of each bolster is supported by a spring group positioned in the center opening of the side frame and supported by the lower portion of the side frame that defines the center opening.

Each truck also includes two axles that support the side frames, four wheels, and four roller bearing assemblies respectively mounted on the ends of the axles. The truck further includes four bearing adapters respectively positioned on each roller bearing assembly in the respective pedestal jaw opening below the downwardly facing wall of the side frame that defines the top of the pedestal jaw opening. The wheelsets of the truck are thus received in bearing adapters placed in leading and trailing pedestal jaws in the side frames, so that axles of the wheelsets are generally parallel. The bearing adapters permit relatively slight angular displacement of the axles. The spring sets or groups permit the bolster to move somewhat with respect to the side frame, about longitudinal or horizontal, vertical, and transverse axes (and combinations thereof).

Directions and orientations herein refer to the normal orientation of a vehicle (such as a railroad car) in use. Thus, unless the context clearly requires otherwise, the "longitudinal" axis or direction is substantially parallel to a straight part of the path (such straight tracks) and in the direction of movement of the vehicle along that portion of the path in either direction. The "transverse" or "lateral" axis or direction is in a horizontal direction transverse (such as perpendicular) to the longitudinal axis. The "leading" side of the truck means the first side of a truck to encounter a turn, and the "trailing" side is opposite of the leading side. A truck is considered "square" when its wheels are aligned in parallel (such a parallel on the tracks) and the axles are parallel to each other and perpendicular to the side frames.

Existing trucks do not fully address the ever increasing and expected future demands for vehicle performance such as freight railroad car truck performance in the railroad industry. More specifically, while the various current known and commercially available three piece truck configurations meet current Association of American Railroads ("AAR") specifications, enhanced specifications are being developed by the AAR and it is expected that the current three piece truck configurations may not meet these new AAR specifications. These AAR enhanced specifications set forth or codify these continuing and ongoing demands in the railroad industry for improved freight railroad car truck performance to: (a) reduce railroad car component wear and damage such as wheel wear and damage; (b) reduce rolling resistance; (c) reduce fuel consumption; (d) reduce the need for and thus cost of railroad track repair (including reducing the cost of track and tie maintenance); (e) reduce truck hunting and improve high speed stability ("HSS") for both empty and loaded railroad cars; and (f) improve curving performance for both empty and loaded railroad cars.

Ideally, on straight tracks, a three piece truck with parallel side frames and parallel wheelset axles perpendicular to the side frames (i.e., a perfectly "square" truck) rolls without inducing lateral or transverse forces between the wheel tread and the track. However, at higher speeds, even minor imperfections or perturbations in the tracks or in the equipment can lead to a condition known as "hunting". Hunting refers to a yawing or oscillating lateral movement of the wheelsets along the tracks that causes the railroad car to move side-to-side on the tracks. More than minor imperfections or perturbations in the tracks or in the railroad car equipment or components can lead to greater truck hunting even at lower speeds. Hunting tends to increase wheel wear and damage, increase fuel consumption, increase the need for railroad track repair, and decrease HSS. In certain instances, hunting has also led to derailments, damage to the lading, and damage to the freight railroad cars.

Curved railroad tracks pose a different set of challenges for the standard three-piece truck. When a railroad car truck encounters a curve or turn, the distance traversed by the wheels on the outside of the curve is greater than the distance traversed by wheels on the inside of the curve, resulting in lateral and longitudinal forces between the respective wheels and the tracks. These wheel forces often cause the wheelset to turn in a direction opposing the curve or turn. On trucks with insufficient rigidity, this can result in a condition variously known as "warping," "lozenging," "parallelogramming," and/or "unsquaring," wherein the side frames remain parallel, but one side frame moves forward with respect to the other side frame. This condition is referred to herein as warping for brevity.

Another known issue relates to various known 3-piece railroad truck suspensions that have side frames with flat rectangular surfaces against which friction wedges are pressed to produce frictional (i.e., Coulomb) damping to control vertical bounces and other oscillatory modes. Normally, significant clearance exists between the side frame's column face and nearby surfaces of the bolster to enable assembly and proper relative motion during use. This clearance is undesirable in that it enables the truck assembly to become warped or change shape from the intended parallel and perpendicular arrangement (i.e., to undergo warping).

Such warping alone or in combination with hunting can cause increased wear on the tracks and railroad car truck components or equipment. Such warping alone or in combination with hunting also tends to increase rolling resistance that increases railroad car fuel consumption, decreases railroad car efficiency, and increases railroad engine pollution.

Various railroad car truck steering assemblies for railroad car trucks have been proposed to address various of these issues. These proposed steering assemblies have various issues.

For example, the railroad car truck steering assembly proposed in U.S. Pat. No. 5,647,283 includes steering arms attached to bearing adapters. The steering arms have overlapping end portions that define elongated apertures through which a pin is inserted to connect the steering arms. This arrangement enables the arms to slide relative to each other, allowing the wheelset axles to develop an inter-axle yaw angle while physically inhibiting inter-axle shearing movements. This steering assembly allows out of phase yaw movement with respect to the two axels, and provides a physical restriction against in-phase yaw movement. Because of this arrangement, potentially large forces act on the components of the steering assembly, risking breakage of the components or introducing additional modes of failure.

In another example, the railroad car truck steering assembly proposed in European Patent No. 2,886,412 includes elastic elements connecting wheelsets of a railroad car truck. The elastic elements prevent in-phase yaw movement of the wheelsets by physically restricting movement of the wheelsets. As a result, potentially large forces act on the components of the steering assembly, risking breakage of the components or introducing additional modes of failure.

Accordingly, there is a need to meet the ongoing demands in the for improved vehicle performance (such as improved railroad car truck performance). The above issues and needs are recognized by the inventors.

SUMMARY

Various embodiments of the present disclosure provide a new vehicle car truck underslung steering assembly that reduces, inhibits, and/or minimizes the truck hunting, warping, and related issues. Further various embodiments of the present disclosure provide a new vehicle (such as a new railroad car) with one or more car trucks with such underslung steering assemblies. In various embodiments, the car truck with the underslung steering assembly of the present disclosure includes a first side frame, a second side frame, a bolster, and an underslung steering assembly.

More specifically, in various embodiments of the present disclosure, the car truck of the present disclosure includes: a first side frame, a second side frame, and an underslung steering assembly coupled to the first side frame and the second side frame. The underslung steering assembly includes: (1) a plurality of steering arms; (2) a plurality of L-shaped force transfer elbows; (3) a plurality of side frame connection brackets; (4) a plurality of pivotable short linkages; (5) a plurality of lateral short linkages; (6) a plurality of transverse force transfer legs; and (7) a transom. In various embodiments of the present disclosure, each component of the underslung steering assembly is made from steel. In various embodiments of the present disclosure, the underslung steering assembly is configured to apply forces to the roller bearings and/or bearing adapters at the end of each wheelset (and thus the wheelsets and wheels) to reduce, inhibit, and/or minimize truck hunting, warping, and other issues. More specifically, when the car truck starts to hunt or warp, the underslung steering assembly applies opposing biasing forces to the bearing assemblies of the side frames to reduce in-phase yaw movement of the wheelsets of the car truck, and thus reduces, inhibits, and/or minimizes truck hunting as well as warping.

It should also be appreciated that although the underslung steering assembly of the present disclosure is not primarily intended to produce resistance against other undesired directional movements of the side frames and bolster, in various circumstances and embodiments, the underslung steering assembly of the present disclosure can act or co-act to permit certain directional movements and/or can act or co-act to reduce, inhibit, and/or minimize certain other undesired directional movements alone or in combination with other components of the car truck.

Other objects, features, and advantages of the present disclosure will be apparent from the following detailed disclosure, taken in conjunction with the accompanying sheets of drawings, wherein like reference numerals refer to like parts.

DETAILED DESCRIPTION

Figure 1A:
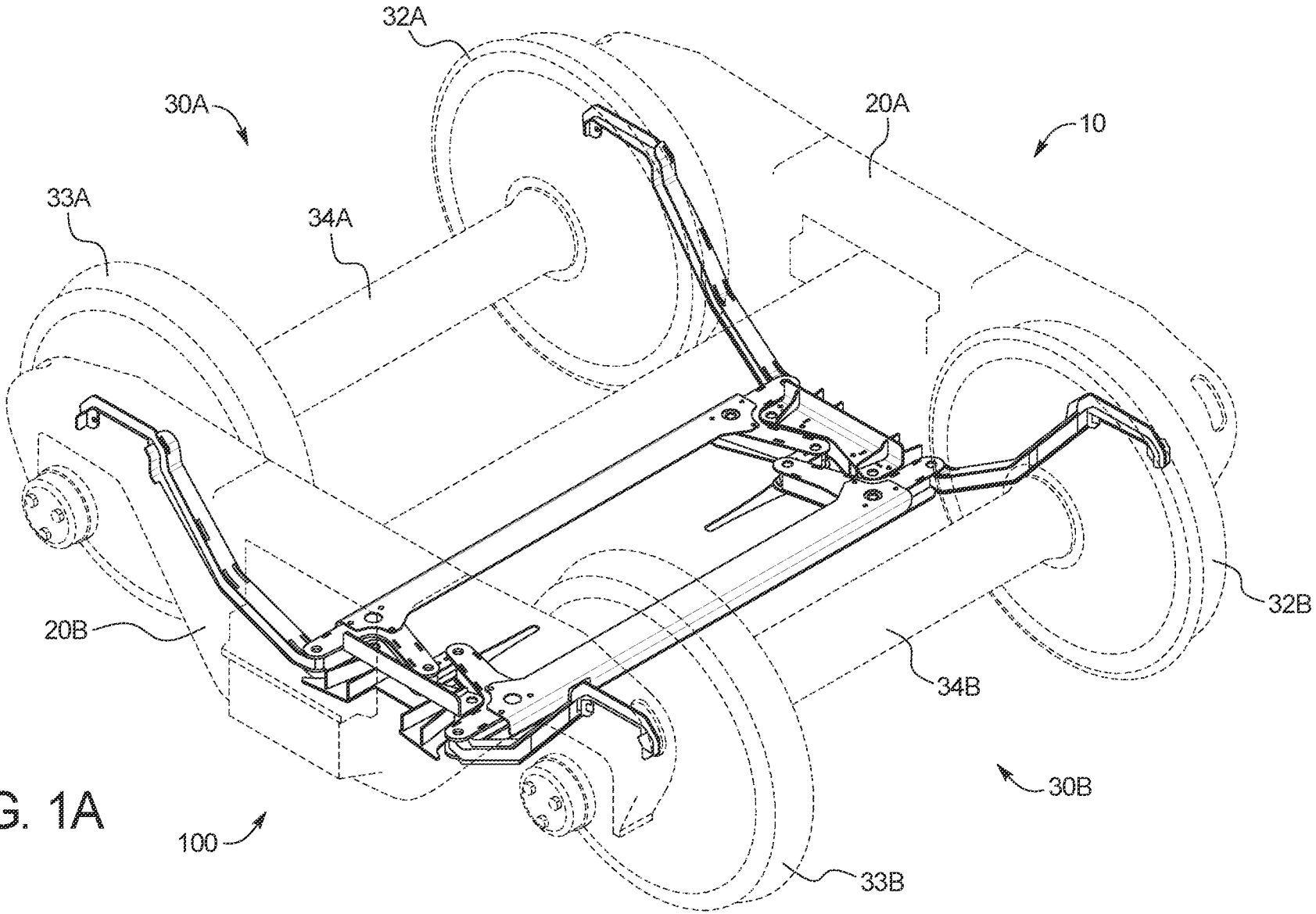
FIG. 1A is a top perspective view of an example underslung steering assembly of the present disclosure, shown attached to an example car truck and specifically in this example a railroad car truck, with the railroad car truck shown in phantom.
Figure 1B:
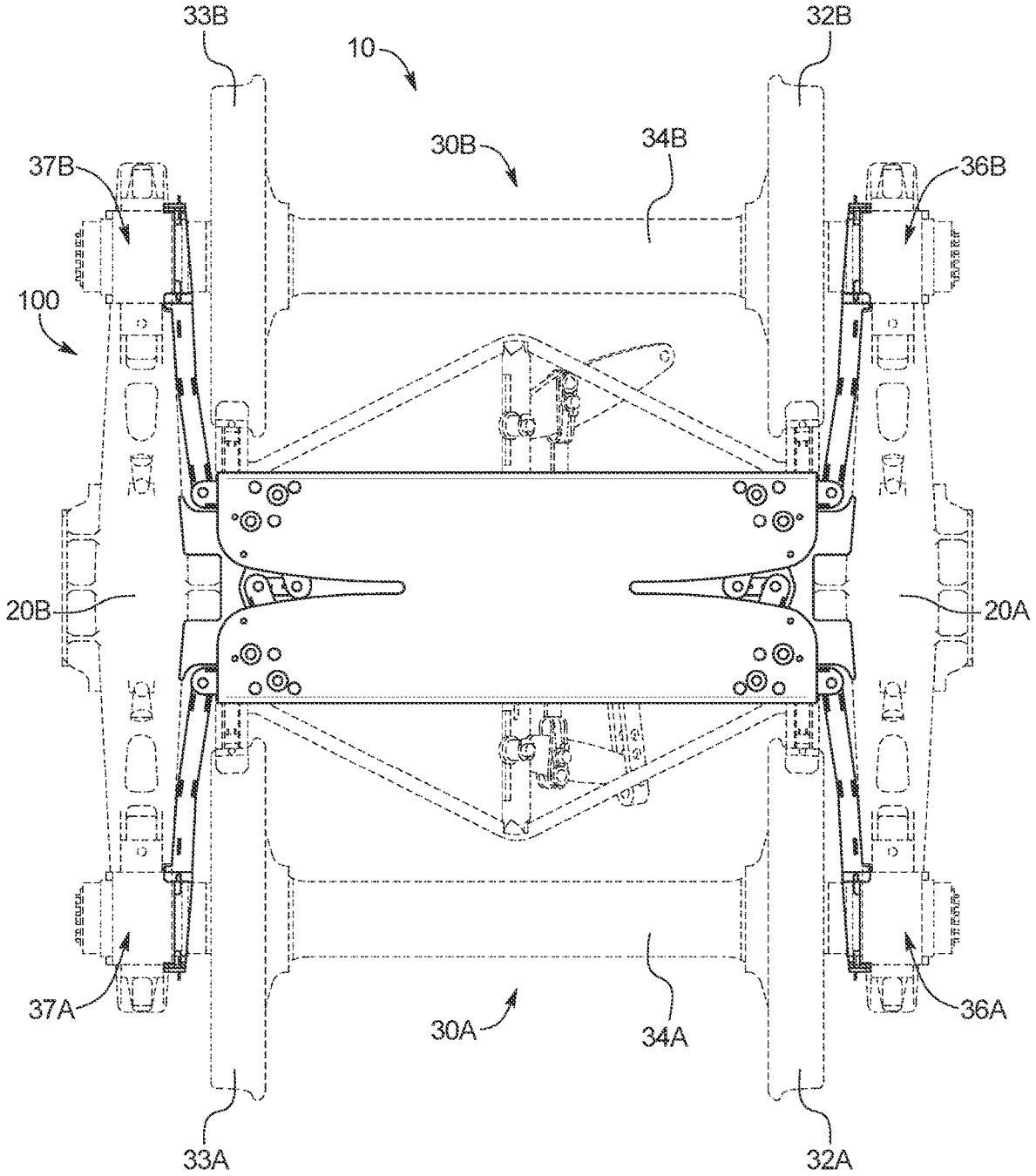
FIG. 1B is a bottom view of the underslung steering assembly and railroad car truck of FIG. 1, with the railroad car truck shown in phantom.
Figure 1C:
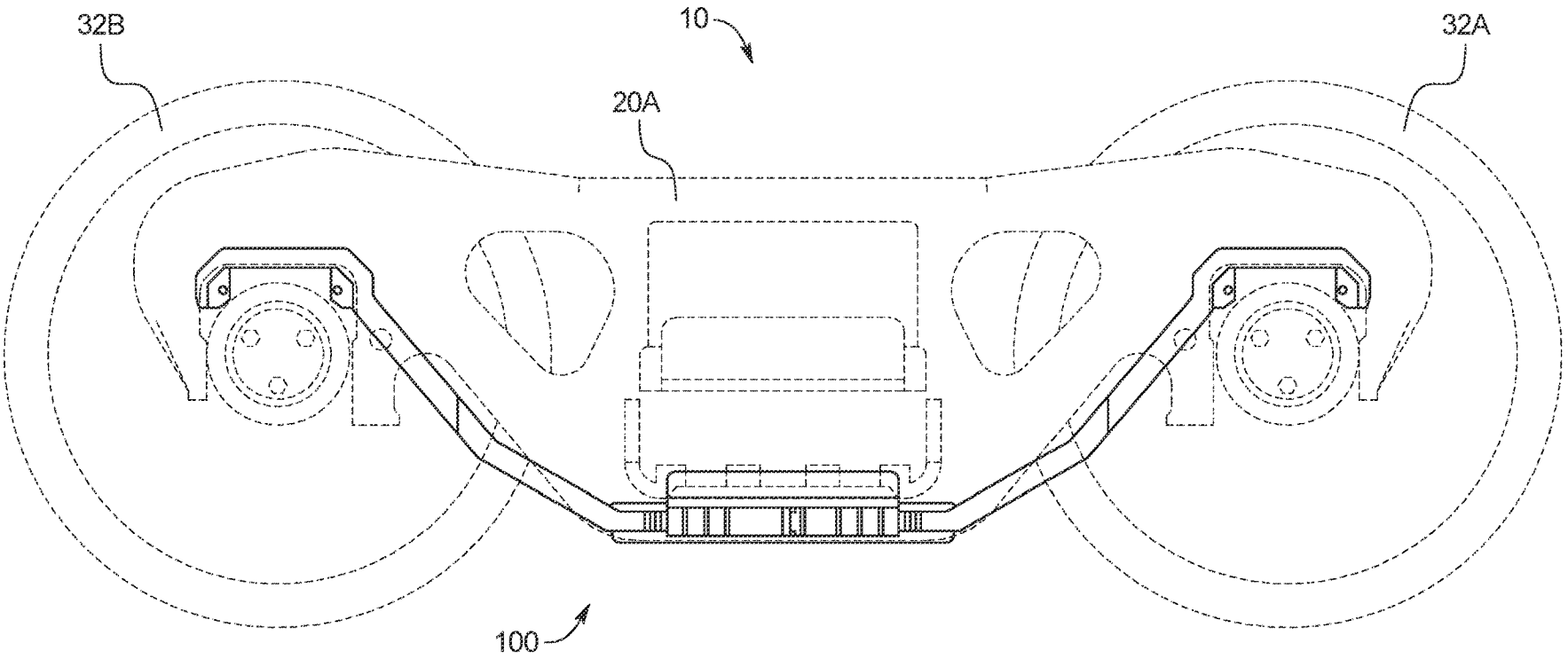
FIG. 1C is a side view of the underslung steering assembly and railroad car truck of FIG. 1, with the railroad car truck shown in phantom.
Figure 1D:
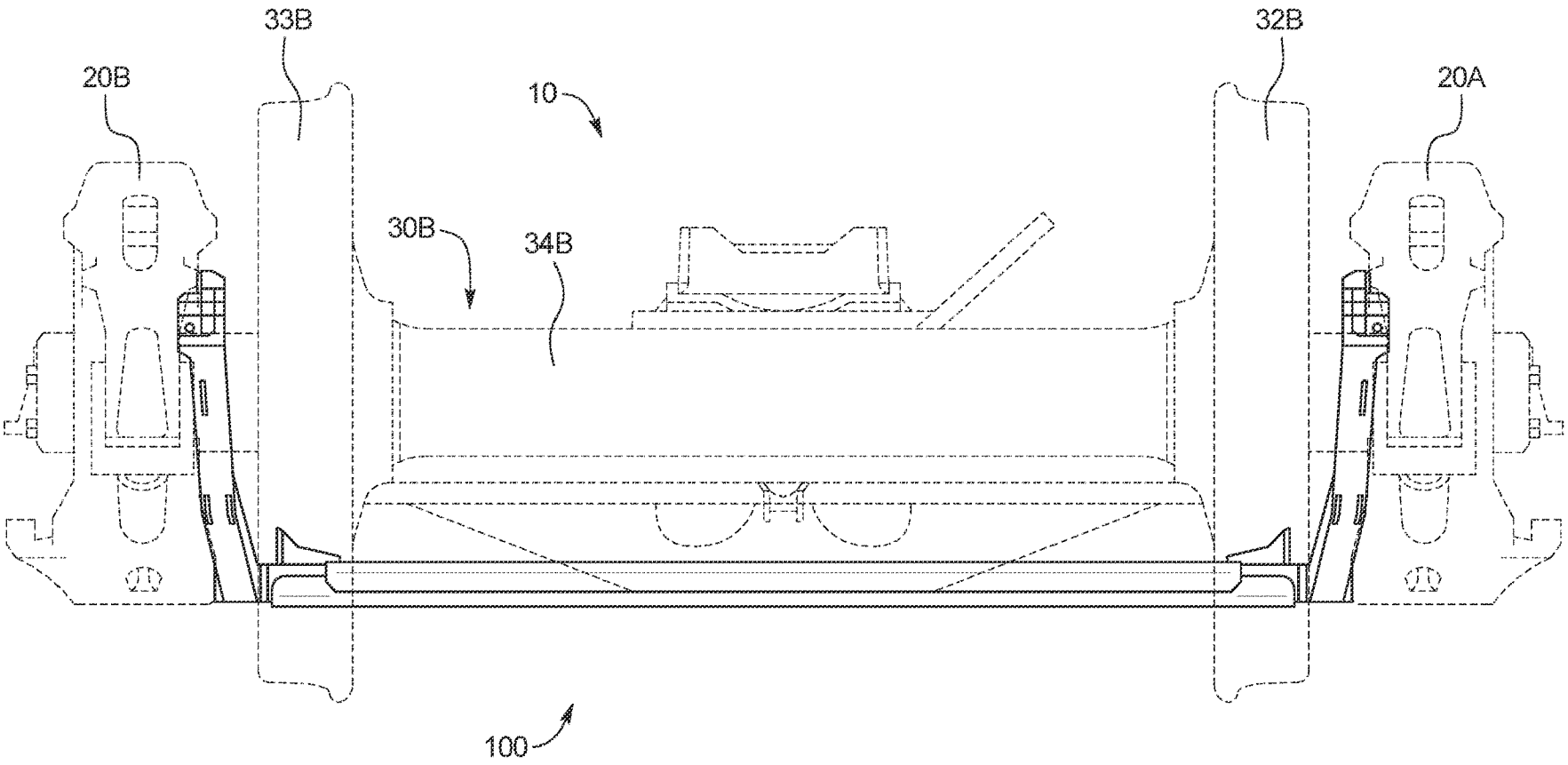
FIG. 1D is a rear view of the underslung steering assembly and railroad car truck of FIG. 1, with the railroad car truck shown in phantom.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, and the like, are not intended to be limited to direct mounting methods but should be interpreted broadly to include indirect and operably coupled, mounted, connected and like mounting methods. This specification is intended to be taken as a whole and interpreted in accordance with the principles of the present disclosure and as understood by one of ordinary skill in the art.

Referring now to the drawings and particularly to FIGS. 1A, 1B, 1C, 1D, an example car truck (and particularly an example railroad car truck) is generally indicated by numeral 10 and is shown in phantom. An example underslung steering assembly of one embodiment of the present disclosure is generally indicated by numeral 100 and shown attached to the car truck 10. The car truck 10 includes a bolster, a bolster bowl of the bolster, a first side frame 20A, a second side frame 20B, a first wheelset 30A, and a second wheelset 30B. The first wheelset 30A includes two wheels 32A and 33A, and an axle 34A. The second wheelset 30B includes two wheels 32B and 33B, and an axle 34B. Axle 34A is coupled to the first side frame 20A by a first bearing adapter 36A. Axle 34A is also coupled to the second side frame 20B by a second bearing adapter 37A. Axle 34B is coupled to the first side frame 20A by a third bearing adapter 36B. Axle 34B is coupled to the second side frame 20B by a second bearing adapter 37B.

Each wheelset 30A and 30B has a center of yaw about which it rotates, along a plane parallel to a path such as to tracks. When the truck 10 enters a curve in path such as in the tracks, such as a left curve, the right front wheel will move forward relative to the right rear wheel, and the left front wheel will move backward relative to the left rear wheel. These movements are relatively small, such as ⅜ of an inch or less, depending on the extend of the curve in the path such as the track.

The present disclosure contemplates that it is beneficial to encourage opposite movement directions by wheels on the same side, while discouraging movement in the same direction. Regarding the issues noted above, encouraging opposite movement direction while discouraging movement in the same direction by wheels on the same side of the car truck can reduce in-phase yaw movement of the wheelsets, and thus reduces, inhibits, and/or minimizes truck hunting as well as warping.

It should be appreciated that while the present disclosure uses a railroad car truck as the example car truck, the present disclosure is not limited to railroad car trucks.

FIGS. 2A, 2B, 2C, 2D, 3, 4, 5, 6, 7, and 8, further show this example embodiment of the underslung steering assembly 100 of the present disclosure.

This example underslung steering assembly 100 generally includes: (1) first, second, third, and fourth steering arms 200A-D; (2) first, second, third, and fourth L-shaped force transfer elbows 300A-D; (3) first and second side frame connection brackets 400A-B; (4) first, second, third, and fourth pivotable short linkages 500A-D; (5) first and second lateral short linkages 600A-B; (6) first and second transverse force transfer legs 700A-B; and (7) a transom 800.

In this example embodiment, the underslung steering assembly 100 includes components that are mirror images of each other. However, it should be appreciated that these components do not need to be mirror images in accordance with the present disclosure. For example, the underslung steering assembly 100 includes a left side and a right side that mirror each other. Further, the underslung steering assembly 100 includes first, second, third, and fourth steering arms 200A-D (among other components) that mirror each other depending on which side of the assembly 100 they are positioned. For the sake of simplicity, only one of each similar component is primarily described in detail. It should be understood, however, that each similar component can operate in the same manner, and may be a flipped or mirrored version of the component described.

I. STEERING ARMS

The first steering arm 200A is operable to transfer forces from the front right wheel 32A to the first L-shaped force transfer elbow 300A, and vice versa. The first steering arm 200A is similar or identical to steering arms 200B, 200C, and 200D, so only steering arm 200A will be described in further detail. The first steering arm 200A includes: (1) a bearing adapter connector 210A; (2) a force transfer elbow connector 220A; and (3) a middle section 230A. The second, third, and fourth steering arms 200B, 200C, and 200D include corresponding bearing adapter connectors 210B-D, force transfer elbow connectors 220B-D, and middle sections 230B-D.

The bearing adapter connector 210A of the first steering arm 200A is configured such that it engages with and couples to the bearing adapter 36A. In the illustrated embodiment, the bearing adapter connector 210A is configured in an upside down "U" shape, such that it matches the profile of the bearing adapter 36A. The bearing adapter connector 210A is configured to engage the bearing adapter 36A on the top side of the axle 34A. The bearing adapter connector 210 defines a plurality of horizontally oriented apertures (not labeled) that can be used along with a fasteners (not shown) to affix the bearing adapter connector 210A to the bearing adapter 36A. The bearing adapter connector 210A is configured to transfer force to and from the bearing adapter 36A. In other example embodiments of the present disclosure, the bearing adapter connector 210A can alternatively be coupled by an appropriate mechanism to the axle 34A (either directly, or via one or more intermediate components), at an end of the axle 34A proximate the front right wheel 32A.

The force transfer elbow connector 220A of the first steering arm 200A is configured to transfer forces to and from the first L-shaped force transfer elbow 300A. The force transfer elbow connector 220A is generally flat and horizontally oriented. The force transfer elbow connector 220A is positioned below the axle 34A. The force transfer elbow connector 220A defines an elbow connector aperture 240A that is oriented in an upright position to engage with the first L-shaped force transfer elbow 300A. In the illustrated embodiment, the elbow connector aperture 240A is also surrounded and/or defined by an upright tube oriented transverse to the ground.

The middle section 230A of the first steering arm 200A is connected to the bearing adapter connector 210A and the force transfer elbow connector 220A. In various example embodiments, the bearing adapter connector 210A, the force transfer elbow connector 220A, and the middle section 230A are integrally formed.

II. L-SHAPED FORCE TRANSFER ELBOWS

The first L-shaped force transfer elbow 300A is operable to transfer forces from the first steering arm 200A to the various other components described herein, and vice versa. In particular, the first L-shaped force transfer elbow is rotatably coupled to the first steering arm 200A, the pivotable short linkage 500A, the lateral short linkage 600A, the transverse force transfer leg 700A, and the transom 800. The first L-shaped force transfer elbow 300A is configured to transfer forces between these components. The first L-shaped force transfer elbow 300A is similar or identical to L-shaped force transfer elbows 300B, 300C, and 300D, so only L-shaped force transfer elbow 300A will be described in further detail. The first L-shaped force transfer elbow 300A includes: (1) a top member 310A; (2) a bottom member 320A; and (3) an upright stabilizer member 330A. In addition, L-shaped force transfer elbow 300A defines: (4) a steering arm attachment aperture 340A; (5) a middle attachment aperture 342A; and (6) a lateral short linkage attachment aperture 344A.

The top member 310A includes an L-shaped plate oriented in a plane parallel or generally parallel to the ground. The legs of the top member form an acute angle. In the illustrated example embodiment, the top member 310A is oriented such that the middle bend of the top member 310A is positioned inward and toward the front of the truck (i.e., toward axle 34A).

The bottom member 320A includes an L-shaped plate oriented in a plane parallel or generally parallel to the ground, and that mirrors or matches the top member 310A. The legs of the bottom member form an acute angle that matches the angle of the top member 310A. In the illustrated example embodiment, the bottom member 320A is oriented such that the middle bend of the bottom member 320A is positioned inward and toward the front of the truck (i.e., toward axle 34A).

The upright stabilizer 330A includes one or more plates connected to the top member 310A and the bottom member 320A. The one or more plates of the upright stabilizer 330A are vertically or generally vertically oriented transverse to the side frames. The one or more plates of the upright stabilizer 330A can run along the length of the top member 310A and the bottom member 320A. Alternatively, the one or more plates of the upright stabilizer 330A can run along a partial length of the top member 310A and the bottom member 320A. In other example embodiments, the upright stabilizer 330A can be offset from a center line of the top member 310A and/or the bottom member 320A. In other example embodiments, the upright stabilizer 330A can include matching plates that are offset toward the outside edges of the top member 310A and the bottom member 320A, such that a channel is formed by the top member 310A, the bottom member 320A, and the two plates of the upright stabilizer 330A.

Figure 6:
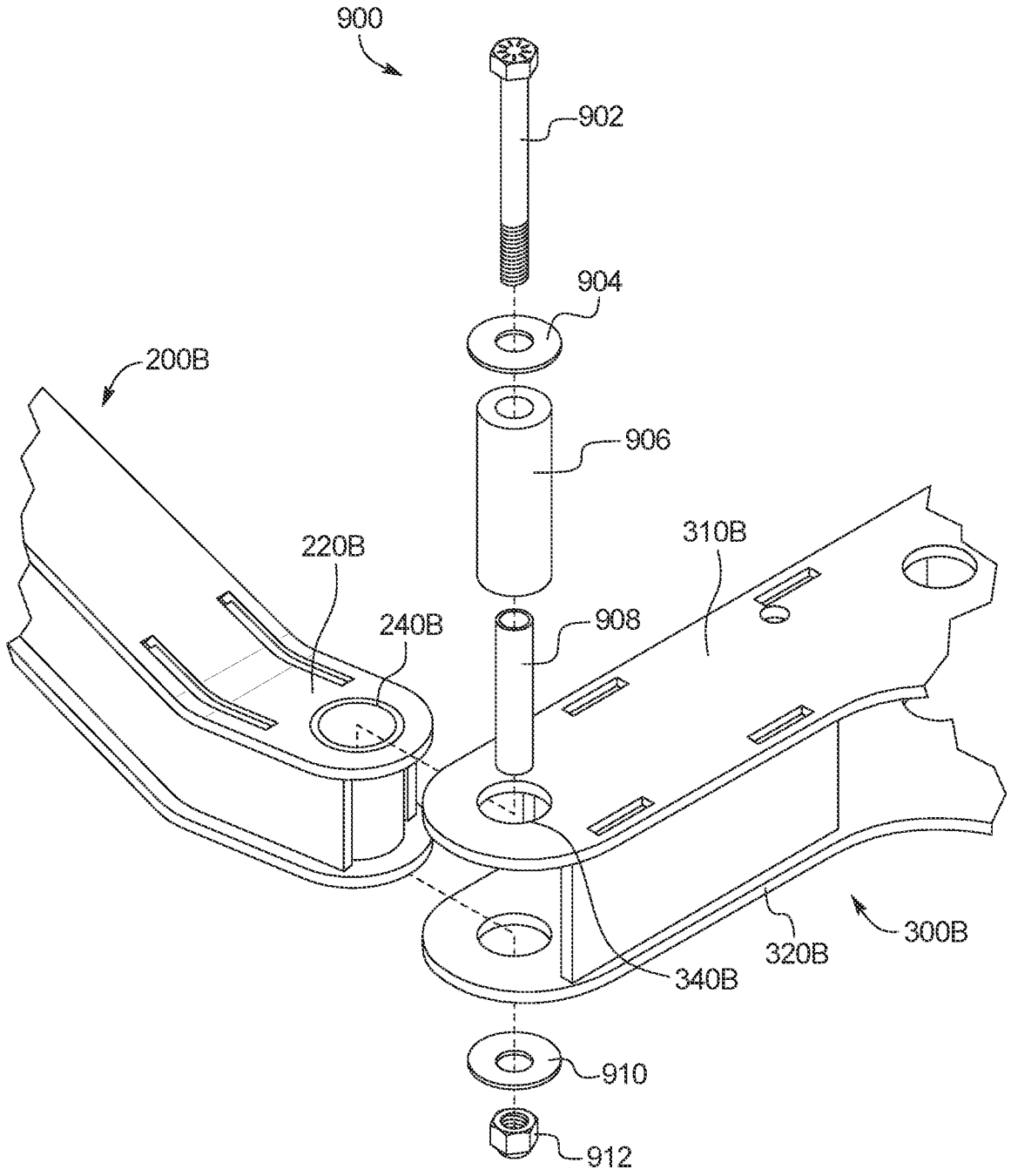
FIG. 6 is an exploded partial fragmentary top perspective view of a coupling between a steering arm and an L-shaped force transfer elbow of the underslung steering assembly of FIG. 1.

As noted above, the first L-shaped force transfer elbow 300A defines a steering arm attachment aperture 340A. The steering arm attachment aperture 340A is oriented in an upright direction, and extends through both the top member 310A and the bottom member 320A. The steering arm attachment aperture 340A is positioned proximate a first end of the L-shaped force transfer elbow 300A, shown best in FIG. 5. The steering arm attachment aperture 340A is aligned with the elbow connector aperture 240A of the first steering arm 200A. To couple the first steering arm 200A to the first L-shaped force transfer elbow 300A, the first steering arm 200A is inserted between the top member 310A and the bottom member 320A, such that the apertures 240A and 340A align. A fastener (not shown) is then inserted through the apertures to couple the components together, and enable them to rotate with respect to each other. It should be appreciated that FIG. 6 shows an exploded fragmentary mirror image of this "A" corner assembly.

Additionally, the first L-shaped force transfer elbow 300A defines a middle attachment aperture 342A. The middle attachment aperture 342A is oriented in an upright direction, and extends through both the top member 310A and the bottom member 320A. The middle attachment aperture 342A is positioned proximate a middle bend of the L-shaped force transfer elbow 300A at which the legs of the elbow meet. The middle attachment aperture 342A is aligned with: (1) the force transfer elbow attachment aperture 542A of the pivotable short linkage 500A, (2) the leg alignment aperture 710A of the transverse force transfer leg 700A, and (3) the transom-elbow alignment aperture 820A of the transom 800. To couple these components together, the pivotable short linkage 500A is positioned between the top member 310A and the bottom member 320A, and the L-shaped force transfer elbow 300A is positioned between the transverse force transfer leg 700A and the transom 800, such that the apertures 342A, 542A, 710A, and 820A align. A fastener (not shown) is then inserted through the apertures to couple one or more of the components together (i.e., the first L-shaped force transfer elbow 300A and the pivotable short linkage 500A), and enable one or more of the components to rotate with respect to one or more of the other components.

Additionally, the first L-shaped force transfer elbow 300A defines a lateral short linkage attachment aperture 344A. The lateral short linkage aperture 344A is oriented in an upright direction, and extends through both the top member 310A and the bottom member 320A. The lateral short linkage attachment aperture 344A is positioned proximate a second end of the elbow 300A, on the other leg from where the steering arm attachment aperture 340A is positioned. The lateral short linkage attachment aperture 344A is aligned with the first force transfer elbow attachment aperture 640A of the lateral short linkage 600A. To couple the L-shaped force transfer elbow 300A to the lateral short linkage 600A, the lateral short linkage 600A is inserted between the top member 310A and the bottom member 320A, such that the apertures 344A and 640A align. A fastener (not shown) is then inserted through the apertures to couple the components together, and enable them to rotate with respect to each other.

In the illustrated example, the L-shaped force transfer elbow 300A is oriented such that the middle bend of the L-shaped force transfer elbow 300A is positioned toward the center and front of the truck 10 (i.e., toward the axle 34A). The second L-shaped force transfer elbow 300B is oriented opposite the first elbow 300A, such that the middle bend of the elbow 300B is positioned toward the center and rear of the truck 10 (i.e., toward the axle 34B). The third and fourth L-shaped force transfer elbows 300C and 300D mirror elbows 300A and 300B.

In the illustrated example embodiment, the first L-shaped force transfer elbow 300A includes an acute angle between the legs of the elbow. The second L-shaped force transfer elbow 300B includes an obtuse angle. Similarly, the third L-shaped force transfer elbow 300C includes an acute angle between its legs, and the fourth L-shaped force transfer elbow 300D includes an obtuse angle. These angles can be seen best in FIG. 3. It should be appreciated, however, that the orientations can be flipped or changed. For example, the angles may be flipped such that the first and third L-shaped force transfer elbows 300A and 300C have obtuse angles between their legs, and the second and fourth L-shaped force transfer elbows 300B and 300D have acute angles. Other orientations and arrangements can be used as well in accordance with the present disclosure.

III. SIDE FRAME CONNECTION BRACKETS

The first side frame connection bracket 400A is operable to anchor the pivotable short linkages 500A and 500B to the side frame 20A. The first side frame connection bracket 400A is similar or identical to the second side frame connection bracket 400B, so only side frame connection bracket 400A will be described in further detail. The first side frame bracket 400A includes: (1) a top plate 402A; (2) a bottom plate 404A; and (3) upright stabilizers 406A. Additionally, the first side frame connection bracket 400A defines: (4) a first pivotable short linkage aperture 410A; (5) a second pivotable short linkage aperture 412A; and (6) first and second pairs of transom attachment apertures 420A/422A and 420B/422B.

Figure 7:
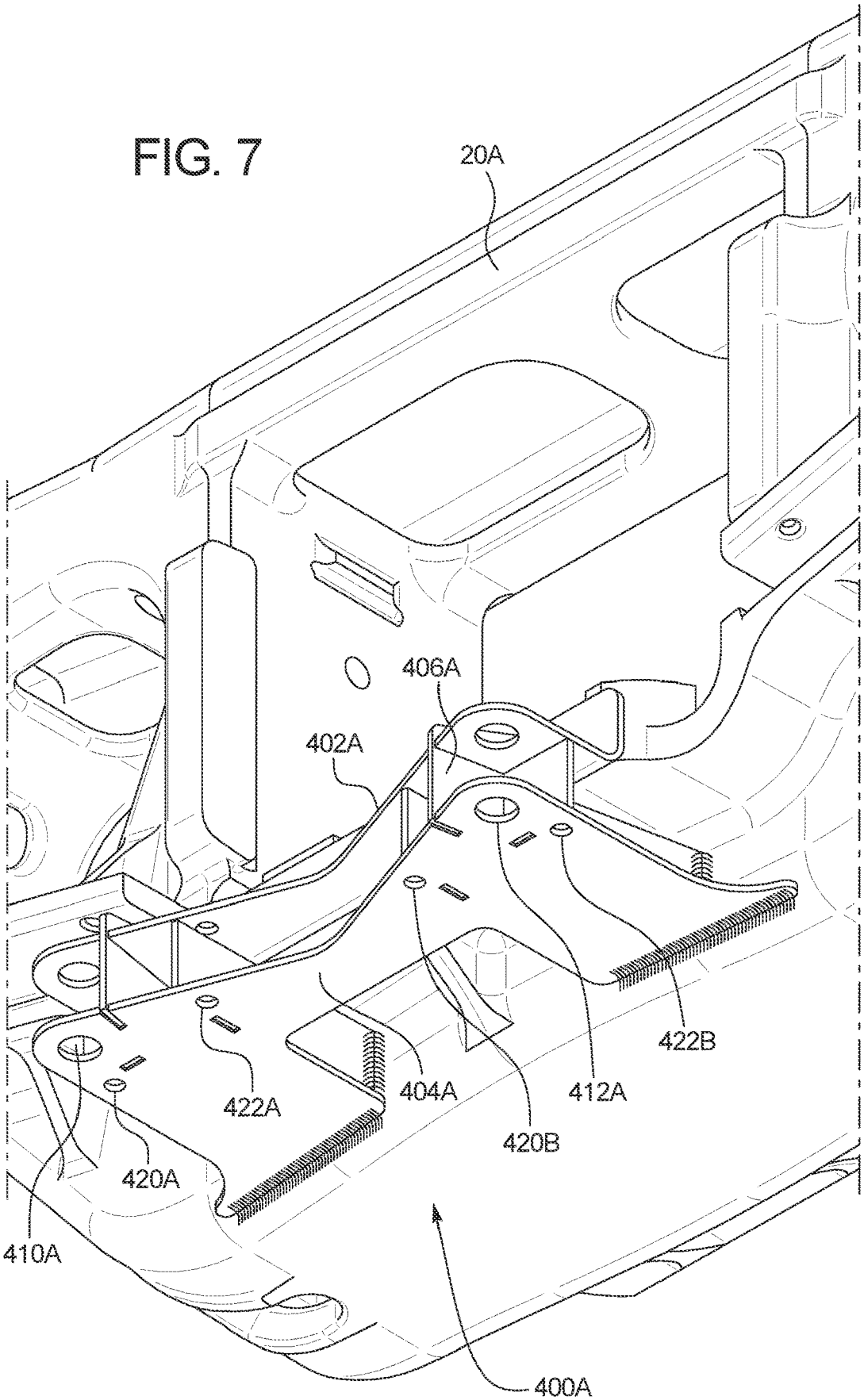
FIG. 7 is a fragmentary bottom perspective view of part of a side frame connection bracket of the underslung steering assembly of FIG. 1 attached to a side frame of the railroad car truck.
Figure 8:
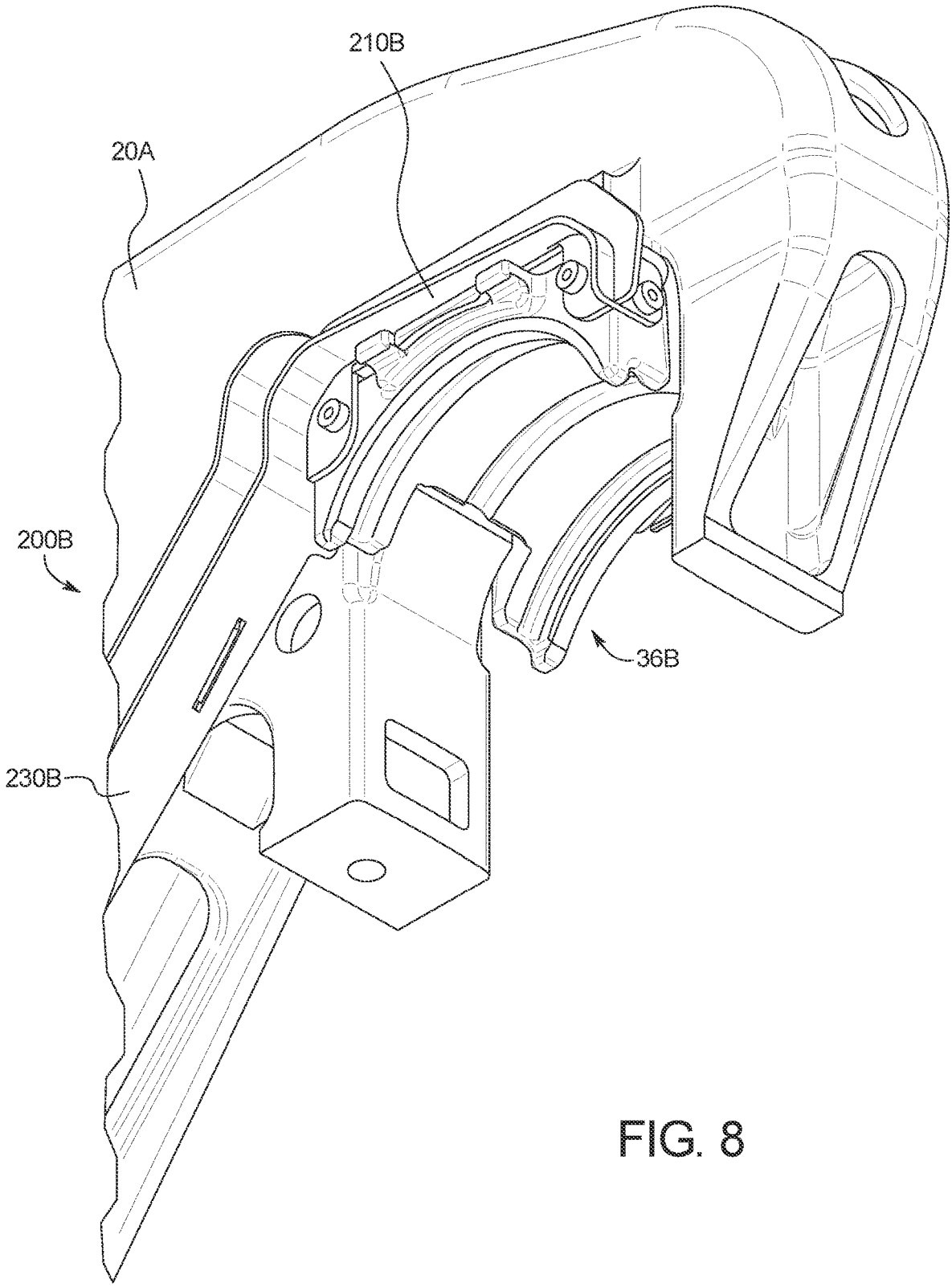
FIG. 8 is a fragmentary bottom perspective view of a steering arm of the underslung steering assembly of FIG. 1, coupled to a bearing adapter of the railroad car truck.

The top plate 402A and the bottom plate 404A are spaced apart, and connected by one or more upright stabilizers 406A. The first side frame connection bracket 400A is affixed to the first side frame 20A. Specifically, the bottom plate 404A is oriented generally parallel to the ground, and is welded along its edge to the side frame 20A. Further, one or more of the upright stabilizers 406A are oriented transverse to the ground, and are also welded along their respective edges to the side frame 20A. These welds are best shown in FIG. 7. In the illustrated example, the top plate 402A and the bottom plate 404A each include a curved edge on their respective inner sides (i.e., the edges opposite those welded to the side frame 20A). The curved edges mirror the angle between the legs of the first L-shaped force transfer elbow 300A.

As noted above, the first side frame connection bracket 400A defines a first pivotable short linkage aperture 410A and a second pivotable short linkage aperture 412A. These apertures are similar or identical to each other. The first pivotable short linkage aperture 410A is positioned proximate a front internal corner of the bracket 400A, and extends through the top plate 402A and the bottom plate 404A. Aperture 410A aligns with the side frame connection bracket attachment aperture 540A of the pivotable short linkage 500A. To couple the first side frame connection bracket 400A to the first pivotable short linkage-500A, the pivotable short linkage 500A is inserted between the top member 402A and the bottom member 404A of the side frame connection bracket 400A, such that the apertures 410A and 540A align. A fastener (not shown) is then inserted through the apertures to couple the components together, and enable the pivotable short linkage 500A to rotate with respect to the side frame connection bracket 400A.

Similarly, the second pivotable short linkage aperture 412A is positioned proximate a rear internal corner of the bracket 400A, and extends through the top plate 402A and the bottom plate 404A. Aperture 412A aligns with the side frame connection bracket attachment aperture (not labeled) of the second pivotable short linkage 500B. To couple the first side frame connection bracket 400A to the second pivotable short linkage 500B, the pivotable short linkage 500B is inserted between the top member 402A and the bottom member 404A of the side frame connection bracket 400A, such that the aperture 412A aligns with the corresponding aperture of the pivotable short linkage 500B. A fastener (not shown) is then inserted through the apertures to couple the components together, and enable the pivotable short linkage 500B to rotate with respect to the side frame connection bracket 400A.

The first side frame connection bracket also defines first and second pairs of transom attachment apertures 420A/422A and 420B/422B. The apertures of each pair are spaced apart, and extend through the top plate 402A and the bottom plate 404A. Apertures 420A and 422A align with apertures 830A and 832A of the transom 800. Apertures 420B and 422B align with apertures 832B and 830B of the transom 800. To couple the first side frame connection bracket 400A to the transom 800, the transom is positioned underneath the first side frame connection bracket 400A such that apertures 830A, 832A, 830B, and 832B align respectively with apertures 420A, 422A, 422B, and 420B. Fasteners (not shown) are then inserted through the apertures to couple the components rigidly together, such that the transom 800 does not rotate with respect to the first side frame connection bracket 400A. A similar connection is made between the transom 800 and the second side frame connection bracket 400B.

IV. PIVOTABLE SHORT LINKAGES

The first pivotable short linkage 500A is operable to pivot about the connections: (1) between the first pivotable short linkage 500A and the first side frame connection bracket 400A; and (2) between the first pivotable short linkage 500A and the first L-shaped force transfer elbow 300A. The first pivotable short linkage 500A is similar or identical to pivotable short linkages 500B, 500C, and 500D, so only pivotable short linkage 500A will be described in further detail. The first pivotable short linkage 500A includes: (1) a top member 510A; (2) a bottom member 520A; and (3) an upright stabilizer member 530A. Additionally, the first pivotable short linkage 500A defines: (4) a side frame connection bracket attachment aperture 540A; and (5) a force transfer elbow attachment aperture 542A.

The top member 510A includes an obround-shaped plate oriented in a plane parallel or generally parallel to the ground.

The bottom member 520A includes an obround-shaped plate oriented in a plane parallel or generally parallel to the ground, and that mirrors or matches the top member 510A.

The upright stabilizer 530A includes one or more plates connected to the top member 510A and the bottom member 520A. The one or more plates of the upright stabilizer 530A are vertically or generally vertically oriented transverse to the tracks. The one or more plates of the upright stabilizer 530A can run along the length of the top member 510A and the bottom member 520A. Alternatively, the one or more plates of the upright stabilizer 530A can run along a partial length of the top member 510A and the bottom member 520A. In other example embodiments, the upright stabilizer 530A can be offset from a center line of the top member 510A and/or the bottom member 520A. In other example embodiments, the upright stabilizer 530A can include matching plates that are offset toward the outside edges of the top member 510A and the bottom member 520A, such that a channel is formed by the top member 510A, the bottom member 520A, and the plate(s) of the upright stabilizer 530A. In addition to the upright stabilizer 530A, both attachment apertures 540A and 542A (discussed below) are also surrounded and/or defined by an upright tube oriented transversely to the ground, and positioned between plates 510A & 520A.

As noted above, the first pivotable short linkage 500A defines a side frame connection bracket attachment aperture 540A. The side frame connection bracket attachment aperture 540A is oriented in an upright direction, and extends through both the top member 510A and the bottom member 520A. The side frame connection bracket attachment aperture 540A is positioned proximate a first end of the first pivotable short linkage 500A, shown best in FIG. 5. The side frame connection bracket attachment aperture 540A is aligned with the first pivotable short linkage aperture 410A of the side frame connection bracket 400A. To couple the first pivotable short linkage 500A to the side frame connection bracket 400A, the pivotable short linkage 500A is inserted between the top plate 402A and the bottom plate 404A of the side frame connection bracket 400A, such that the apertures 540A and 410A align. A fastener (not shown) is then inserted through the apertures to couple the components together, and enable the pivotable short linkage 500A to rotate with respect to the side frame connection bracket 400A.

Additionally, the first pivotable short linkage 500A defines a force transfer elbow attachment aperture 542A. The force transfer elbow attachment aperture 542A is oriented in an upright direction, and extends through both the top member 510A and the bottom member 520A. The force transfer elbow attachment aperture 542A is positioned proximate a second end of the first pivotable short linkage 500A, opposite the side frame connection bracket attachment aperture 540A, shown best in FIG. 5. The force transfer elbow attachment aperture 542A is aligned with the middle attachment aperture 342A of the first L-shaped force transfer elbow 300A. To couple the first pivotable short linkage 500A to the first L-shaped force transfer elbow 300A, the pivotable short linkage 500A is inserted between the top member 310A and the bottom member 320A of the first L-shaped force transfer elbow 300A, such that the apertures 542A and 342A align. A fastener (not shown) is then inserted through the apertures to couple the components together, and enable the components to rotate with respect to each other.

V. LATERAL SHORT LINKAGES

The first lateral short linkage 600A is operable to transfer forces between the first L-shaped force transfer elbow 300A and the second L-shaped force transfer elbow 300B. In addition, the first lateral short linkage 600A is operable to pivot about the connections: (1) between the first lateral short linkage 600A and the first L-shaped force transfer elbow 300A; and (2) between the first lateral short linkage 600A and the second L-shaped force transfer elbow 300B. The first lateral short linkage 600A is similar or identical to the second lateral short linkage 600B, so only the first lateral short linkage 600A will be described in further detail. The first lateral short linkage 600A includes: (1) a top member 610A; (2) a bottom member 620A; and (3) an upright stabilizer member 630A. Additionally, the first lateral short linkage 600A defines: (4) first force transfer elbow attachment aperture 640A; and (5) a second force transfer elbow attachment aperture 642A.

The top member 610A includes an obround-shaped plate oriented in a plane parallel or generally parallel to the ground.

The bottom member 620A includes an obround-shaped plate oriented in a plane parallel or generally parallel to the ground, and that mirrors or matches the top member 510A.

The upright stabilizer 630A includes one or more plates connected to the top member 610A and the bottom member 620A. The one or more plates of the upright stabilizer 630A are vertically or generally vertically oriented transverse to the tracks. The one or more plates of the upright stabilizer 630A can run along the length of the top member 610A and the bottom member 620A. Alternatively, the one or more plates of the upright stabilizer 630A can run along a partial length of the top member 610A and the bottom member 620A. In other example embodiments, the upright stabilizer 630A can be offset from a center line of the top member 610A and/or the bottom member 620A. In other example embodiments, the upright stabilizer 630A can include matching plates that are offset toward the outside edges of the top member 610A and the bottom member 620A, such that a channel is formed by the top member 610A, the bottom member 620A, and the two plates of the upright stabilizer 630A. In addition to the upright stabilizer 630A, both attachment apertures 640A and 642A (discussed below) are also surrounded and/or defined by an upright tube oriented transversely to the ground, and positioned between plates 610A & 620A.

As noted above, the lateral short linkage 600A defines a first force transfer elbow attachment aperture 640A. The first force transfer elbow attachment aperture 640A is oriented in an upright direction, and extends through both the top member 610A and the bottom member 620A. The first force transfer elbow attachment aperture 640A is positioned proximate a first end of the lateral short linkage 600A, shown best in FIG. 5. The first force transfer elbow attachment aperture 640A is aligned with the lateral short linkage attachment aperture 344A of the first L-shaped force transfer elbow 300A. To couple the lateral short linkage 600A to the first L-shaped force transfer elbow 300A, the lateral short linkage 600A is inserted between the top member 310A and the bottom member 320A of the first L-shaped force transfer elbow 300A, such that the apertures 640A and 344A align. A fastener (not shown) is then inserted through the apertures to couple the components together, and enable the components to rotate with respect to each other.

Additionally, the lateral short linkage 600A defines a second force transfer elbow attachment aperture 642A. The second force transfer elbow attachment aperture 642A is oriented in an upright direction, and extends through both the top member 610A and the bottom member 620A. The second force transfer elbow attachment aperture 642A is positioned proximate a second end of the lateral short linkage 600A, shown best in FIG. 5. The second force transfer elbow attachment aperture 642A is aligned with the lateral short linkage attachment aperture (not labeled) of the second L-shaped force transfer elbow 300B. To couple the lateral short linkage 600A to the second L-shaped force transfer elbow 300B, the lateral short linkage 600A is inserted between the top member (not labeled) and the bottom member (not labeled) of the second L-shaped force transfer elbow 300B, such that the aperture 642A aligns with the corresponding aperture of the second L-shaped force transfer elbow 300B. A fastener (not shown) is then inserted through the apertures to couple the components together, and enable the components to rotate with respect to each other.

VI. TRANSVERSE FORCE TRANSFER LEGS

The first transverse force transfer leg 700A is operable to transfer forces between the first L-shaped force transfer elbow 300A and the third L-shaped force transfer elbow 300C. The first transverse force transfer leg 700A is also operable to stabilize the underslung steering assembly 100. The first transverse force transfer leg 700A is similar or identical to the second transverse force transfer leg 700B, so only the first transverse force transfer leg 700A will be described in further detail. The first transverse force transfer leg includes: (1) an elongated bracket member; and defines (2) a first leg alignment aperture 710A, (3) a second leg alignment aperture 712A, (4) a first plurality of force transfer elbow attachment apertures 720A, 722A, and 724A; and (5) a second plurality of force transfer elbow attachment apertures 730A, 732A, and 734A.

The elongated bracket member extends transverse to the tracks. The elongated bracket member includes a horizontal portion, and an upright portion.

The first transverse force transfer leg 700A defines a first leg alignment aperture 710A. The first leg alignment aperture 710A is oriented in an upright direction, and extends through the elongated bracket member. The first leg alignment aperture 710A is positioned proximate a first end of the transverse force transfer leg 700A, proximate the first side frame 20A. The first leg alignment aperture 710A is aligned with: (1) the middle attachment aperture 342A; (2) the force transfer elbow attachment aperture 542A; and (3) the first transom alignment aperture 820A.

Additionally, the first transverse force transfer leg 700A defines a second leg alignment attachment aperture 712A. The second leg alignment aperture 712A is oriented in an upright direction, and extends through the elongated bracket member. The second leg alignment aperture 712A is positioned proximate a second end of the transverse force transfer leg 700A opposite the first end, proximate the second side frame 20B. The second leg alignment aperture 712A is aligned with: (1) the middle attachment aperture (not labeled) of the third L-shaped force transfer elbow 300C; (2) the force transfer elbow attachment aperture (not labeled) of the third pivotable short linkage 500C; and (3) a fifth transom alignment aperture (not labeled) of the transom 800.

The first transverse force transfer leg 700A also defines a first plurality of force transfer elbow attachment apertures 720A, 722A, and 724A. Each of the apertures 720A, 722A, and 724A is oriented in an upright direction, and extends through the elongated bracket member. Apertures 720A, 722A, and 724A are positioned in a triangular formation surrounding the first leg alignment aperture 710A, proximate the first end of the transverse force transfer leg 700A. Apertures 720A, 722A, and 724A are aligned with apertures 350A, 352A, and 354A of the first L-shaped force transfer elbow 300A. To couple the transverse force transfer leg 700A to the first L-shaped force transfer elbow 300A, the transverse force transfer leg 700A is positioned on top of the L-shaped force transfer elbow 300A such that apertures 720A, 722A, and 724A align respectively with apertures 350A, 352A, and 354A. Fasteners (not shown) are then inserted through the apertures to couple the components rigidly together, such that the first transverse force transfer leg 700A does not rotate with respect to the first L-shaped force transfer elbow 300A.

Similarly, the first transverse force transfer leg 700A defines a second plurality of force transfer elbow attachment apertures 730A, 732A, and 734A. Each of the apertures 730A, 732A, and 734A is oriented in an upright direction, and extends through the elongated bracket member. Apertures 730A, 732A, and 734A are positioned in a triangular formation surrounding the second leg alignment aperture 712A, proximate the second end of the transverse force transfer leg 700A. Apertures 730A, 732A, and 734A are aligned with corresponding apertures (not labeled) of the third L-shaped force transfer elbow 300C. To couple the transverse force transfer leg 700A to the third L-shaped force transfer elbow 300C, the transverse force transfer leg 700A is positioned on top of the third L-shaped force transfer elbow 300C such that apertures 730A, 732A, and 734A align respectively with the corresponding apertures of the third L-shaped force transfer elbow 300C. Fasteners (not shown) are then inserted through the apertures to couple the components rigidly together, such that the first transverse force transfer leg 700A does not rotate with respect to the third L-shaped force transfer elbow 300C.

VII. TRANSOM

The transom 800 is operable to transfer forces between the first side and the second side of the underslung steering assembly 100, and to stabilize the components. The transom 800 includes: (1) a plate 810; (2) defines first, second, third, and fourth transom-elbow alignment apertures 820A-D; (3) defines first, second, third, and fourth transom-side frame connection bracket alignment apertures 822A-D; and (4) defines first, second, third, and fourth pairs of side frame connection bracket attachment apertures 830A/832A, 830B/832B, 830C/832C, and 830D/832D.

The plate 810 is generally flat, and includes upright edges that are generally perpendicular to the steering arms 200A-D. The plate 810 defines two opposing spaced apart slots 812A and 812B. The slots 812A and 812B extend from the outer edges inward, on the sides proximate the side frames 20A and 20B. The slots 812A and 812B are symmetrical, and include rounded edges. The slots 812A and 812B are best illustrated in FIG. 2B.

The first, second, third, and fourth force transom-elbow alignment apertures 820A are positioned proximate the four corners of the plate 810. This is shown best in FIG. 2B. Each aperture 820A-D is aligned respectively with the middle attachment apertures of the L-shaped force transfer elbows 300A-D, the force transfer elbow attachment apertures of the pivotable short linkages 500A-D, and the leg alignment apertures of the transverse force transfer legs 700A-B. For example, aperture 820A is aligned with aperture 342A, aperture 542A, and aperture 710A.

Figure 2A:
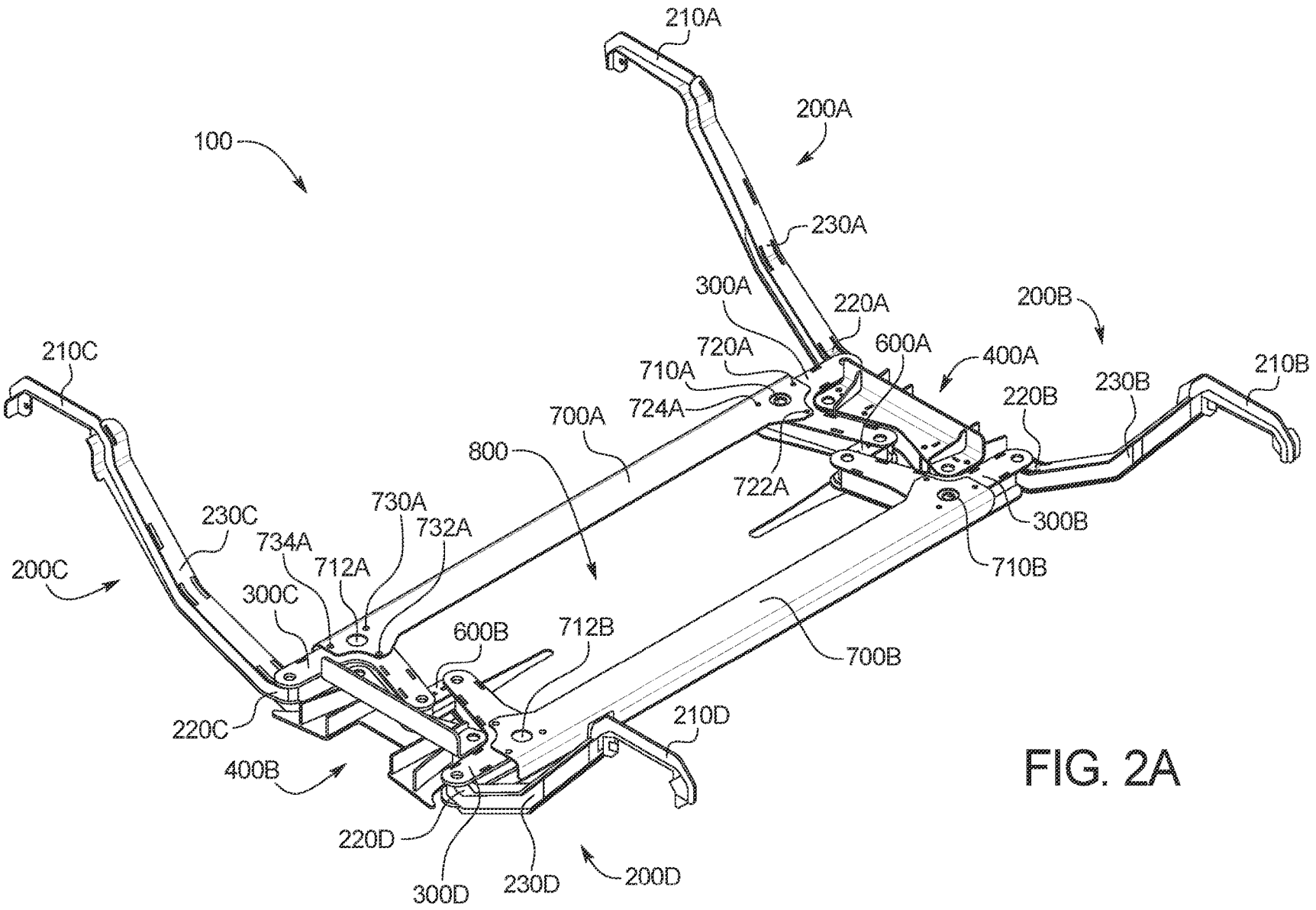
FIG. 2A is a top perspective view of the underslung steering assembly of FIG. 1.
Figure 2B:
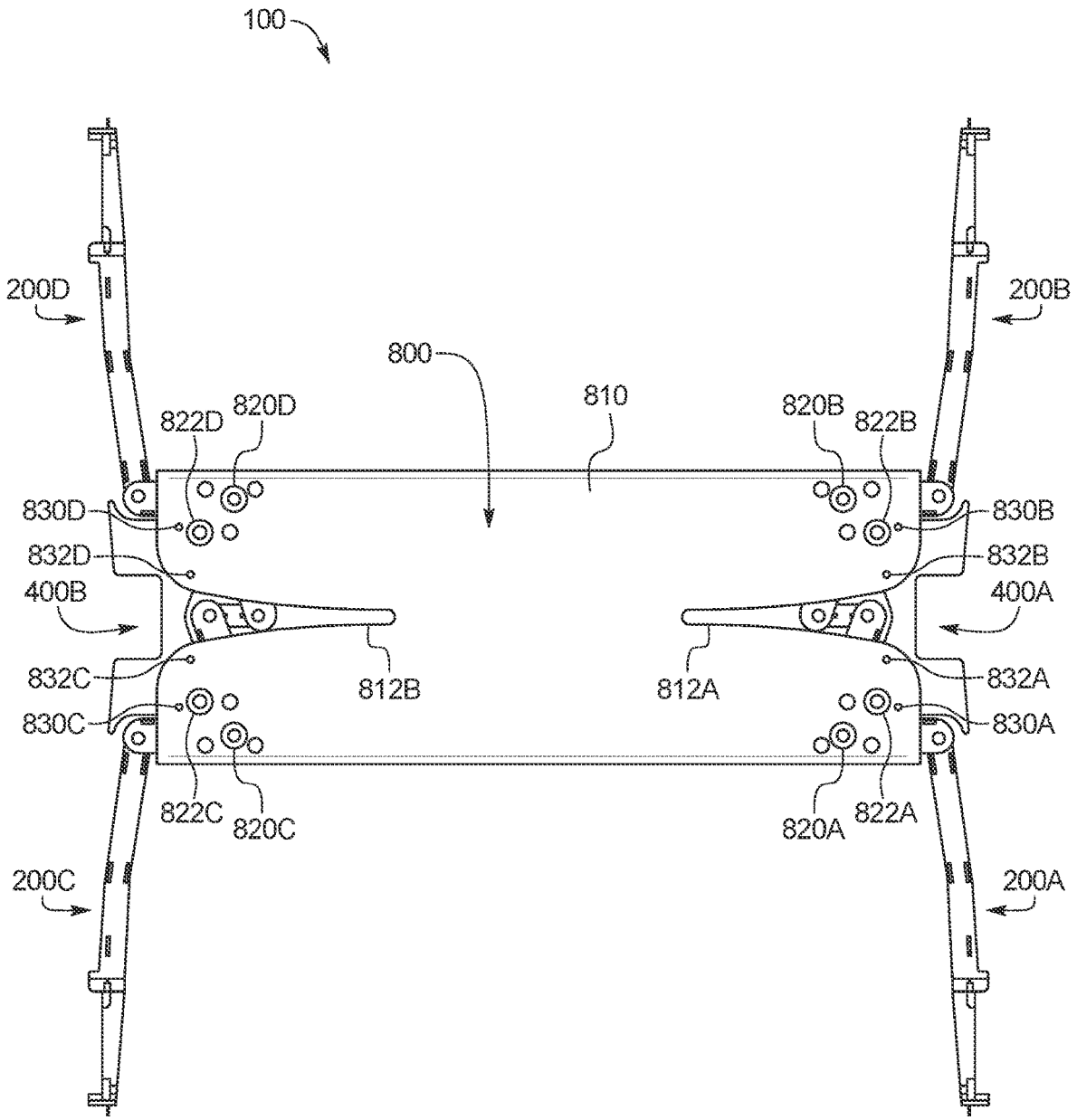
FIG. 2B is a bottom view of the underslung steering assembly of FIG. 1.
Figure 2C:
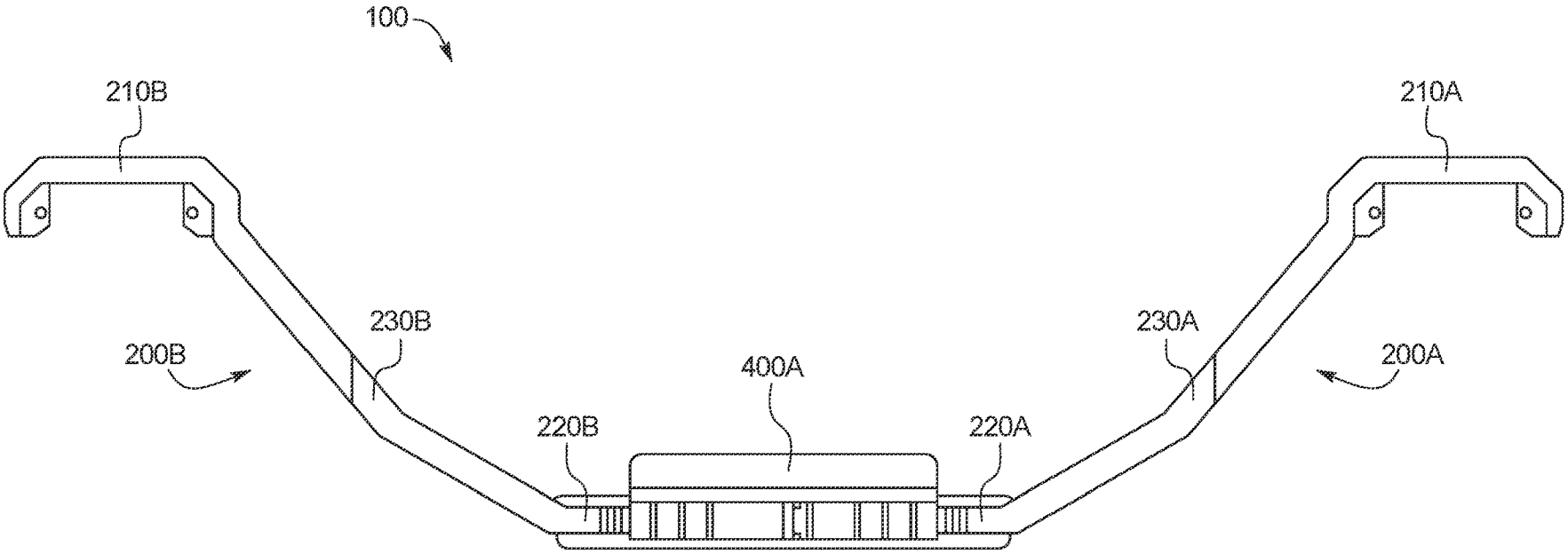
FIG. 2C is a side view of the underslung steering assembly of FIG. 1.
Figure 2D:
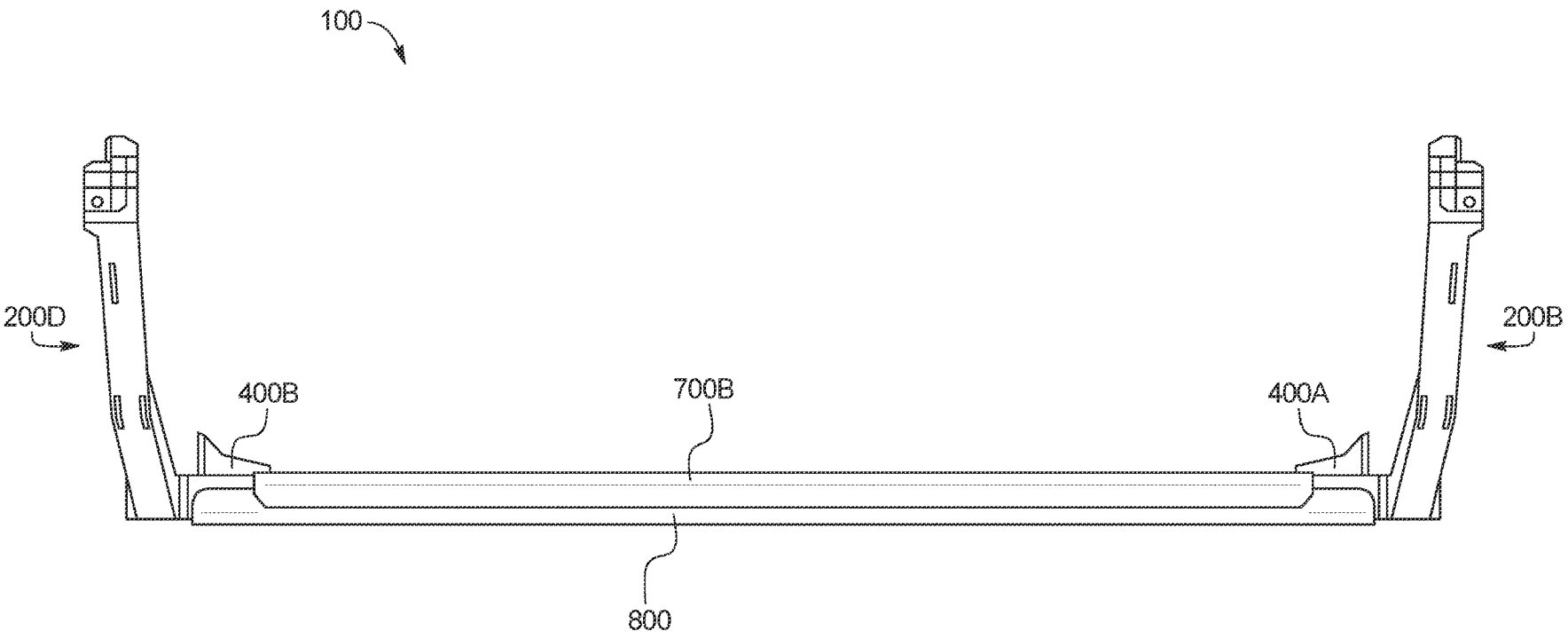
FIG. 2D is a rear view of the underslung steering assembly of FIG. 1.
Figure 3:
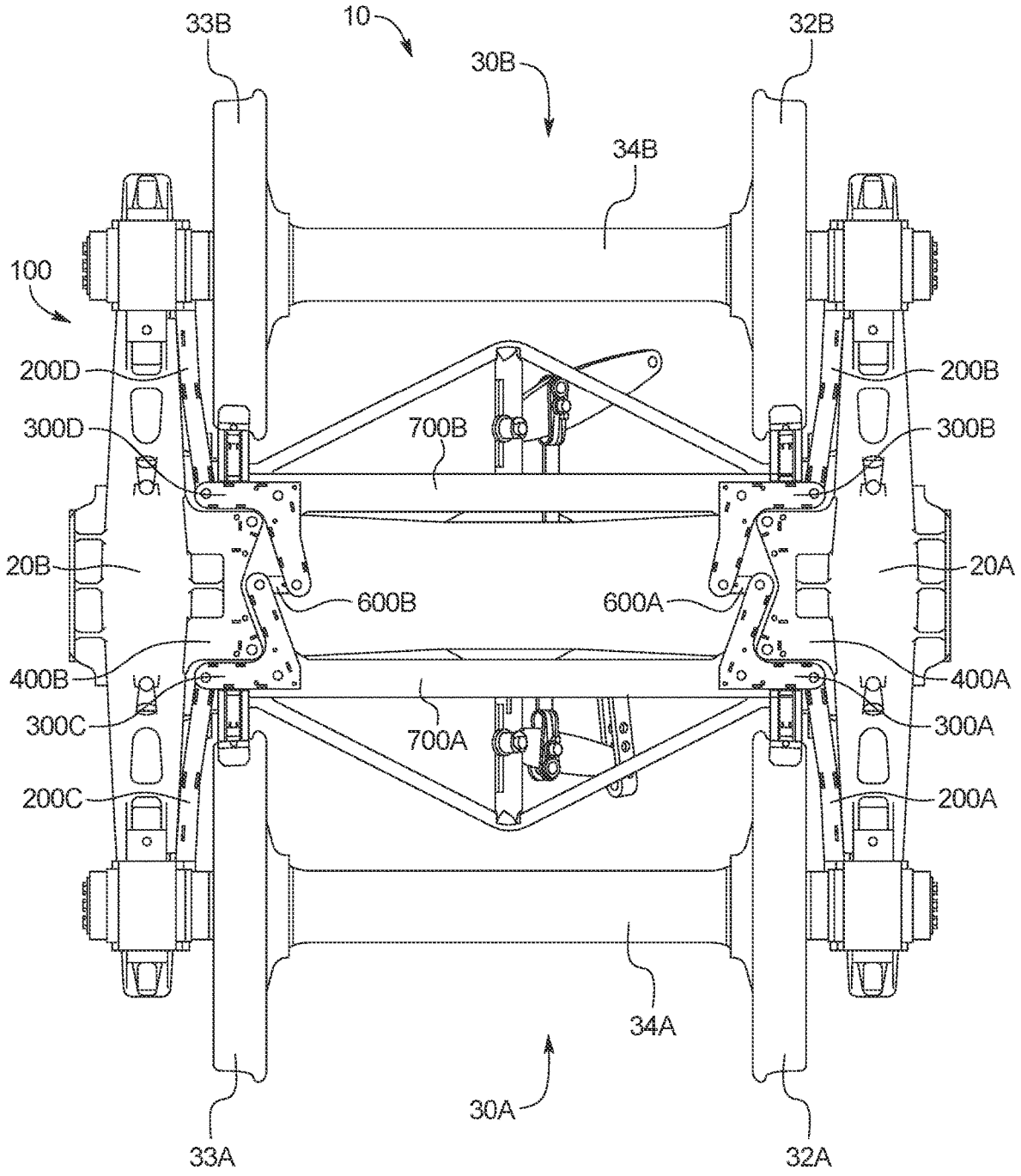
FIG. 3 is a bottom view of the underslung steering assembly and railroad car truck of FIG. 1, with the transom removed from the underslung steering assembly.
Figure 4:
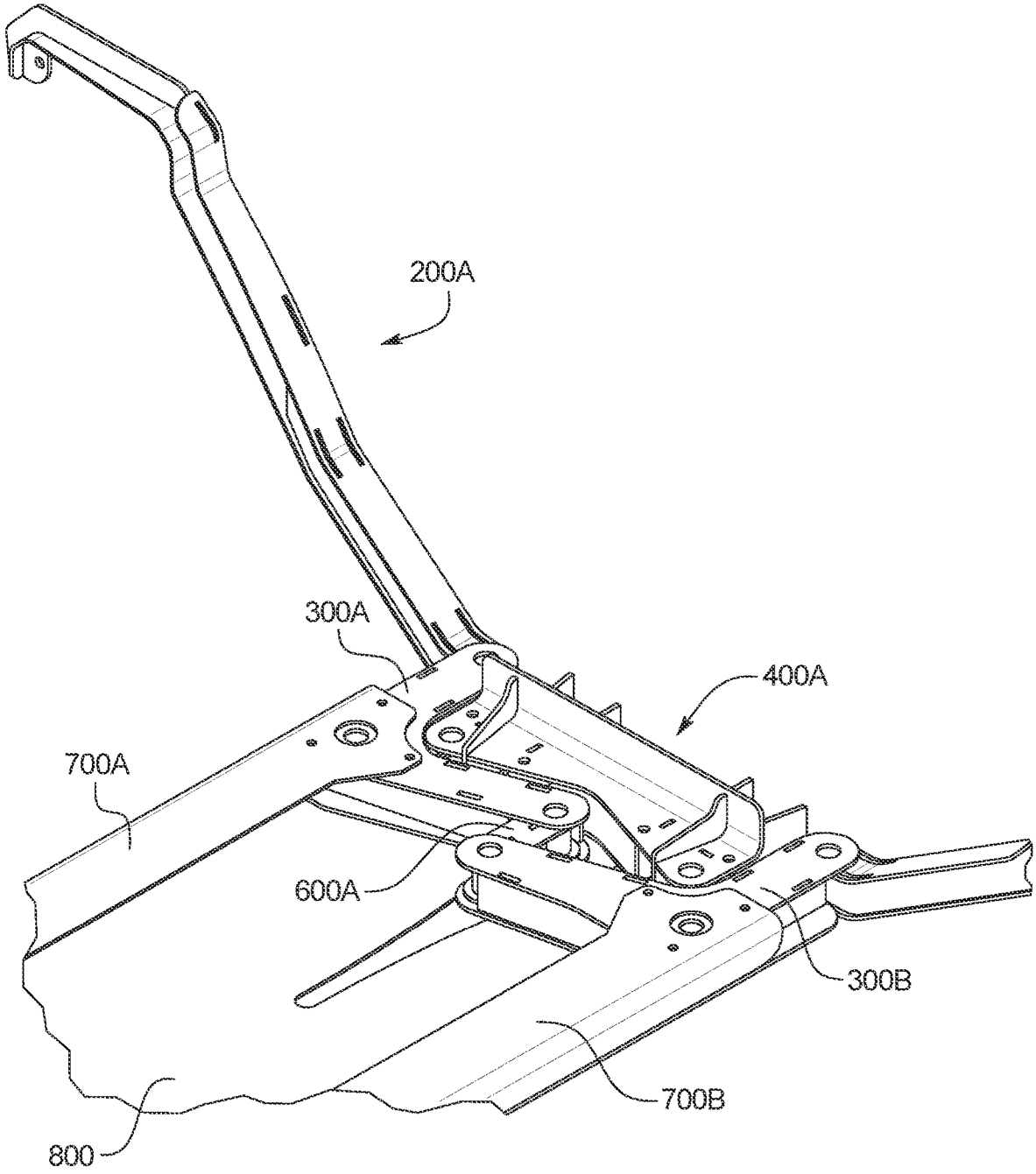
FIG. 4 is a fragmentary top perspective view of part of a first side of the underslung steering assembly of FIG. 1.
Figure 5:
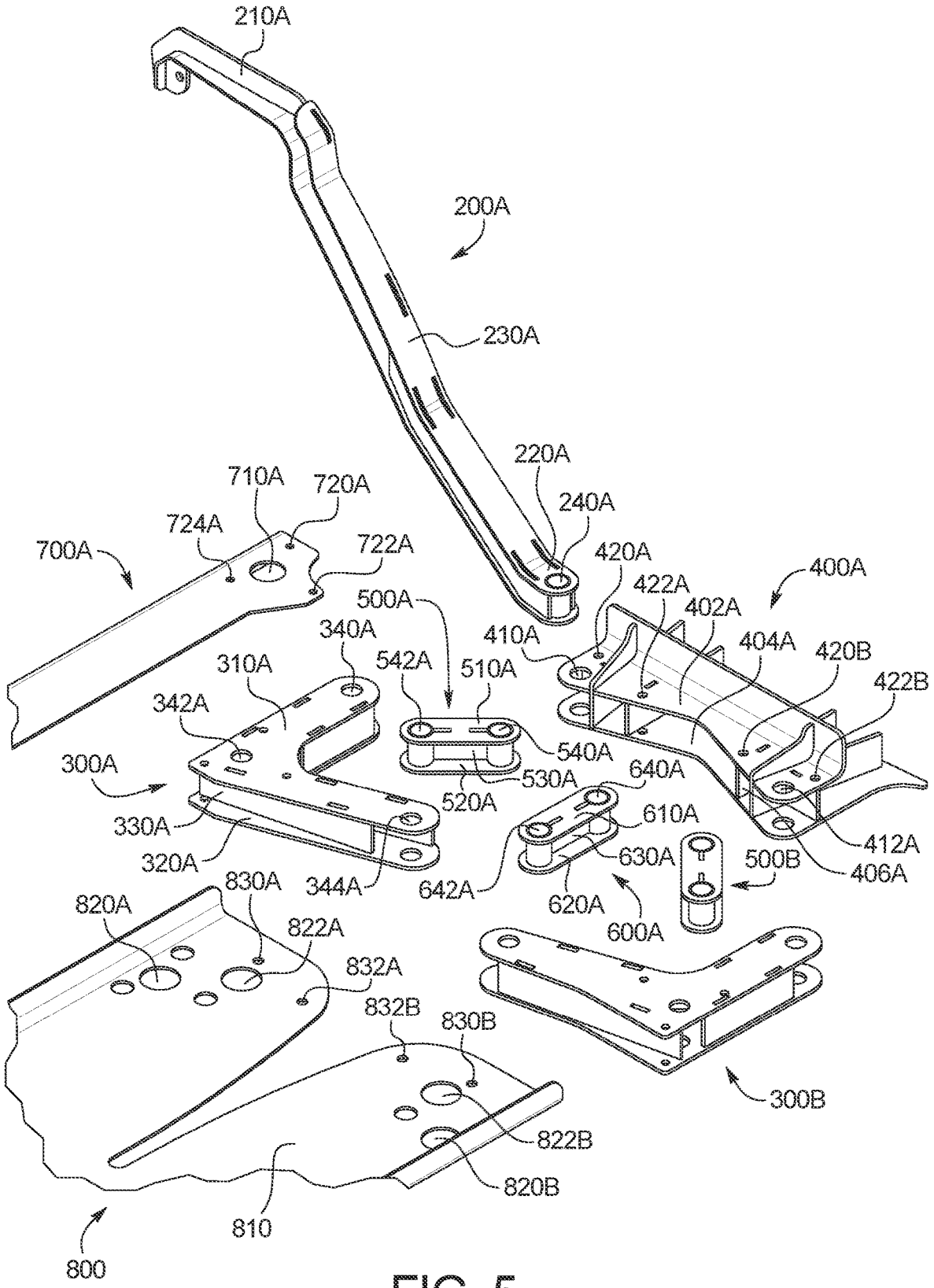
FIG. 5 is an exploded partial fragmentary view top perspective view of part of the first side of the underslung steering assembly shown in FIG. 4.

The first, second, third, and fourth transom-side frame connection bracket alignment apertures 822A-D are also positioned proximate the four corners of the plate 810, as best shown in FIG. 2B. Each aperture 822A-D is aligned respectively with the side frame connection bracket attachment apertures of the pivotable short linkages 500A-D, and with the pivotable short linkage apertures of the side frame connection brackets 400A-B. For example, aperture 822A is aligned with aperture 540A, and with aperture 410A.

The transom 800 also defines first, second, third, and fourth pairs of side frame connection bracket attachment apertures 830A/832A, 830B/832B, 830C/832C, and 830D/832D. The apertures of each pair are oriented in an upright direction, extending through the plate 810 of the transom. The apertures in each pair are spaced apart from each other, and are positioned proximate the edges of the transom 800. Apertures 830A, 832A, 830B, and 832B are aligned with corresponding apertures 420A, 422A, 422B, and 420B of the first side frame connection bracket 400A. Similarly, Apertures 830C, 832C, 830D, and 832D are aligned with corresponding apertures (not labeled) on the second side frame connection bracket 400B. To couple the transom 800 to the first side frame connection bracket 400A, the transom is positioned underneath the first side frame connection bracket 400A such that apertures 830A, 832A, 830B, and 832B align respectively with apertures 420A, 422A, 422B, and 420B. Fasteners (not shown) are then inserted through the apertures to couple the components rigidly together, such that the transom 800 does not rotate with respect to the first side frame connection bracket 400A. A similar connection is made between the transom 800 and the second side frame connection bracket 400B.

VIII. COUPLING AND MATERIALS

FIG. 6 shows an example connection between the second steering arm 200B and the second L-shaped force transfer elbow 300B. The coupling shown in FIG. 6 may be similar or identical to the couplings between various other components described herein. As shown in the illustrated embodiment, the second steering arm 200B (in particular, the force transfer elbow connector 220B) is inserted between the top member 310B and the bottom member 320B of the second L-shaped force transfer elbow 300B. The second elbow connector aperture 240B and the second steering arm attachment aperture 340A are aligned. A fastener 900 is then inserted into the apertures, thereby coupling the second steering arm 200B to the second L-shaped force transfer elbow 300B.

The fastener 900 as illustrated includes: (1) a bolt 902; (2) a first washer 904; (3) an outer spacer 906; (4) an inner spacer 908; (5) a second washer 910; and (6) a nut 912. However, it should be appreciated that other fastening mechanisms can be used instead or in addition.

It should be appreciated that one example embodiment of the underslung steering assembly of the present disclosure is primarily described and illustrated herein. It should be appreciated that one or more components, features, or parts of the underslung steering assembly of the present disclosure may have a different shape, size, orientation, or other characteristic than those specifically explained or illustrated in accordance with the present disclosure. Further, one or more fasteners described herein may be pins, bolts, rivets, welds, or any other mechanisms for attaching one component to another, including both rotatably attaching (i.e., such that full or partial rotation or movement is allowed), and non-rotatably attaching (i.e., such that no rotation or movement is allowed). Further, each component may be made from a suitably strong material. For instance, the steering arms 200A-D, L-shaped force transfer elbows 300A-D, side frame connection brackets 400A-B, pivotable short linkages 500A-D, lateral short linkages 600A-B, transverse force transfer legs 700A-B, and transom 800 may be steel. One or more other parts may be steel as well. Each part may have a specific thickness or grade as well to provide the functions of each part as described herein.

IX. MOVEMENT

As will be described below with respect to FIGS. 9A, 9B, 10A, and 10B, various forces acting on one or more components of the underslung steering assembly 100 can be fully or partially transmitted from one component to another. In addition, one or more components may be configured to flex, bend, or otherwise absorb energy imparted by movement of the components.

FIGS. 9A, 9B 10A, and 10B illustrate how forces acting on one or more components of the underslung steering assembly 100 are fully or partially transferred to one or more other components, resulting in favored orientations of the bearing adapters, wheelsets, and wheels and disfavored orientations of the bearing adapters, wheelsets, and wheels. For brevity, these forces are discussed below with relation to the respective wheels.

Figure 9A:
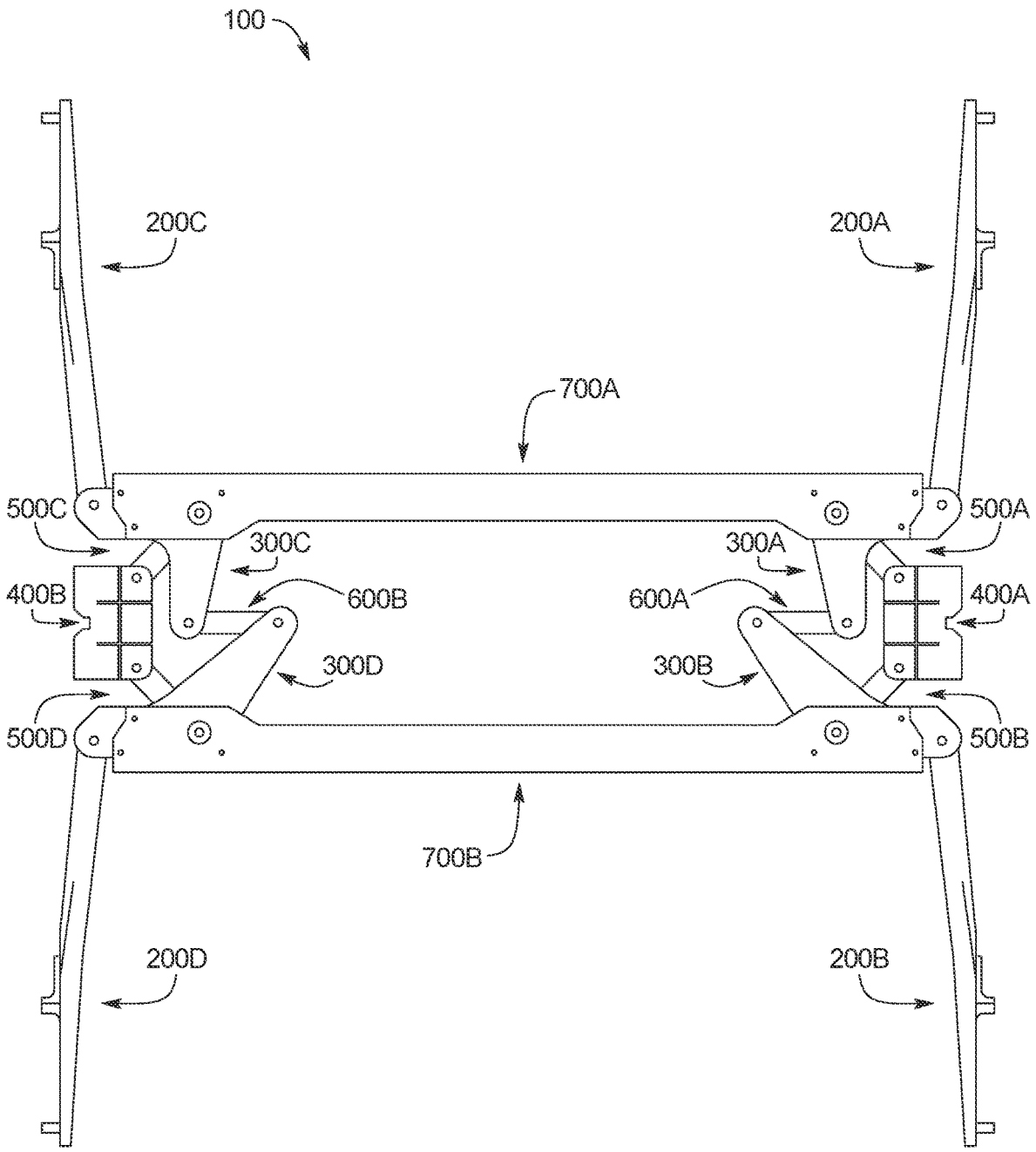
FIG. 9A is a top view of an example underslung steering assembly in a squared position, shown without the transom.

FIG. 9A illustrates a first scenario in which the underslung steering assembly 100 is in a squared orientation. FIG. 9A shows a top view of the underslung steering assembly 100, without the transom 800.

Figure 9B:
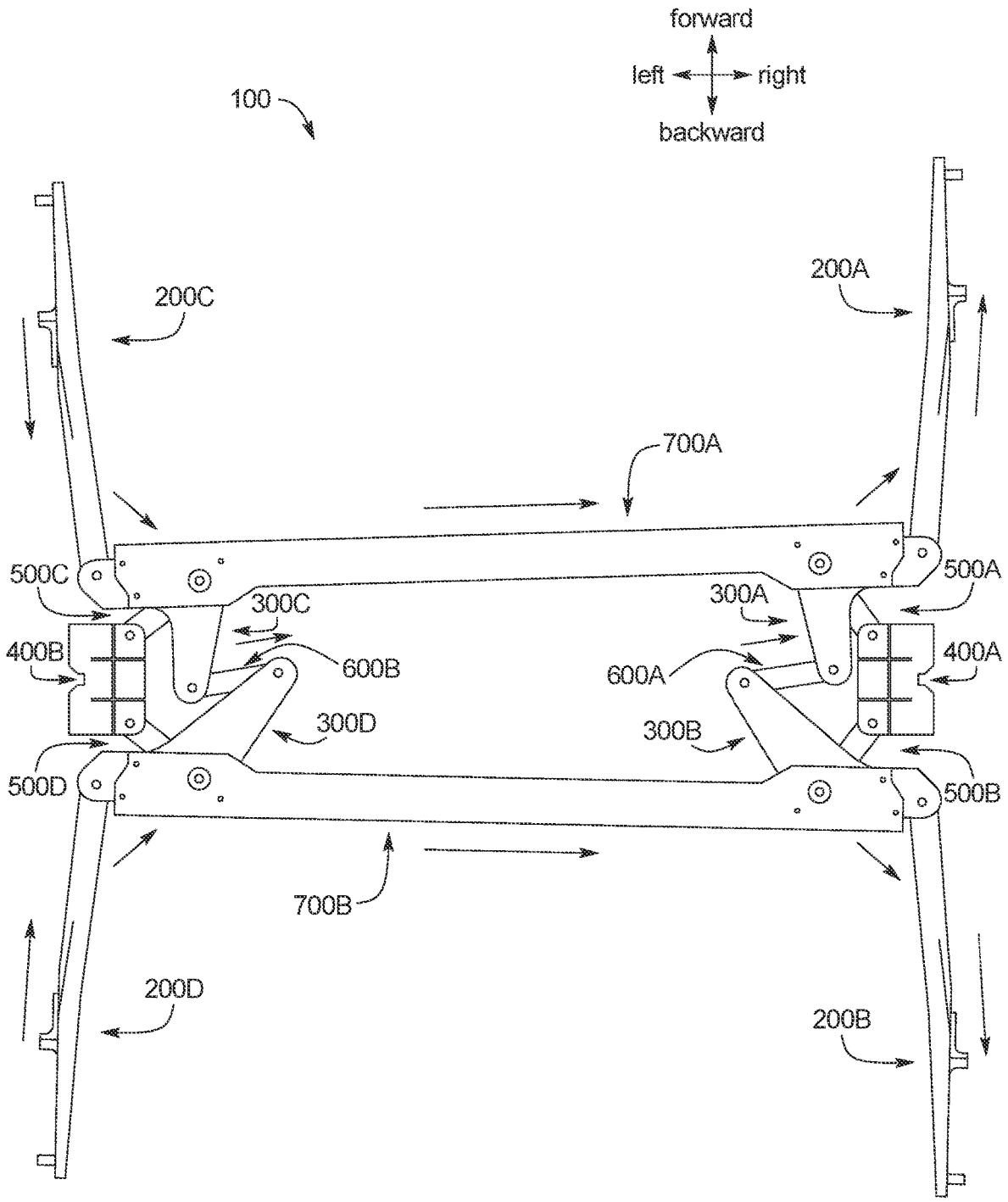
FIG. 9B is a top view of the underslung steering assembly of FIG. 9A shown without the transom, and showing movement of the components of the underslung steering assembly when the right front wheel (top right as shown) has moved forward and the right rear wheel (bottom right as shown) has moved backward.

FIG. 9B illustrates a second scenario, in which a force has acted on the right front wheel (i.e., top right as shown) causing it to move it forward (i.e., upward as shown). Movement of the right front wheel forward causes a cascade of effects as follows:

Top Right Quadrant (1)—movement of the right front wheel forward causes the steering arm 200A to move forward;

(2)—movement of the steering arm 200A forward causes the right side of the first transverse force transfer leg 700A and first L-shaped force transfer elbow 300A to move forward and to the right;

(3)—movement of the right side of the transverse force transfer leg 700A and first L-shaped force transfer elbow 300A forward and to the right causes the first pivotable short linkage 500A to rotate clockwise about its connection to the side frame connection bracket 400A; and (4)—movement of the right side of the first transverse force transfer leg 700A and first L-shaped force transfer elbow 300A forward and to the right also causes the lateral short linkage 600A to move to the right;

Bottom Right Quadrant (5)—movement of the first lateral short linkage 600A to the right causes the second L-shaped force transfer elbow 300B and the right side of the second transverse force transfer leg 700B to move backward and to the right;

(6)—movement of the second L-shaped force transfer elbow 300B and the right side of the second transverse force transfer leg 700B backward and to the right causes the second pivotable short linkage 500B to rotate counter-clockwise about its connection to the side frame connection bracket 400A;

(7)—movement of the second L-shaped force transfer elbow 300B and the right side of the second transverse force transfer leg 700B backward and to the right causes the second steering arm 200B to move backward; and (8)—movement of the second steering arm 200B backward causes the right rear wheel to move backward;

Top Left Quadrant (9)—movement of the right side of the first transverse force transfer leg 700A forward and to the right causes the left side of the first transverse force transfer leg 700A and the third L-shaped force transfer elbow 300C to move backward and to the right;

(10)—movement of the left side of the first transverse force transfer leg 700A and the third L-shaped force transfer elbow 300C backward and to the right causes the third steering arm 200C to move backward;

(11)—movement of the third steering arm 200C backward causes the front left wheel to move backward;

(12)—movement of the left side of the first transverse force transfer leg 700A and the third L-shaped force transfer elbow 300C backward and to the right also causes the third pivotable short linkage 500C to rotate clockwise about its connection to the second side frame connection bracket 400B; and (13)—movement of the left side of the first transverse force transfer leg 700A and the third L-shaped force transfer elbow 300C backward and to the right causes the second lateral short linkage 600B to move to the right;

Bottom Left Quadrant (14)—movement of the second lateral short linkage 600B to the right causes the fourth L-shaped force transfer elbow 300D and the left side of the second transverse force transfer leg 700B to move forward and to the right;

(15)—movement of the second transverse force transfer leg 700B and the fourth L-shaped force transfer elbow 300D forward and to the right causes the fourth pivotable short linkage 500D to rotate counter clockwise about its connection to the second side frame connection bracket 400B;

(16)—movement of the second transverse force transfer leg 700B and the fourth L-shaped force transfer elbow 300D forward and to the right causes the fourth steering arm 200D to move forward; and (17)—movement of the fourth steering arm 200D forward causes the left rear wheel to move forward.

Movements (1)-(17) illustrate the series of causal connections whereby the wheels on the same side of the car truck are biased to move in opposite directions. Additionally, the movements (1)-(17) illustrate movements of an example in which the first movement or initial force is applied to the front right wheel. The same type of causal connections and forces can apply to a scenario in which the initial movement or force is applied to the right rear wheel, the front left wheel, the rear left wheel, or a combination of wheels.

Figure 10A:
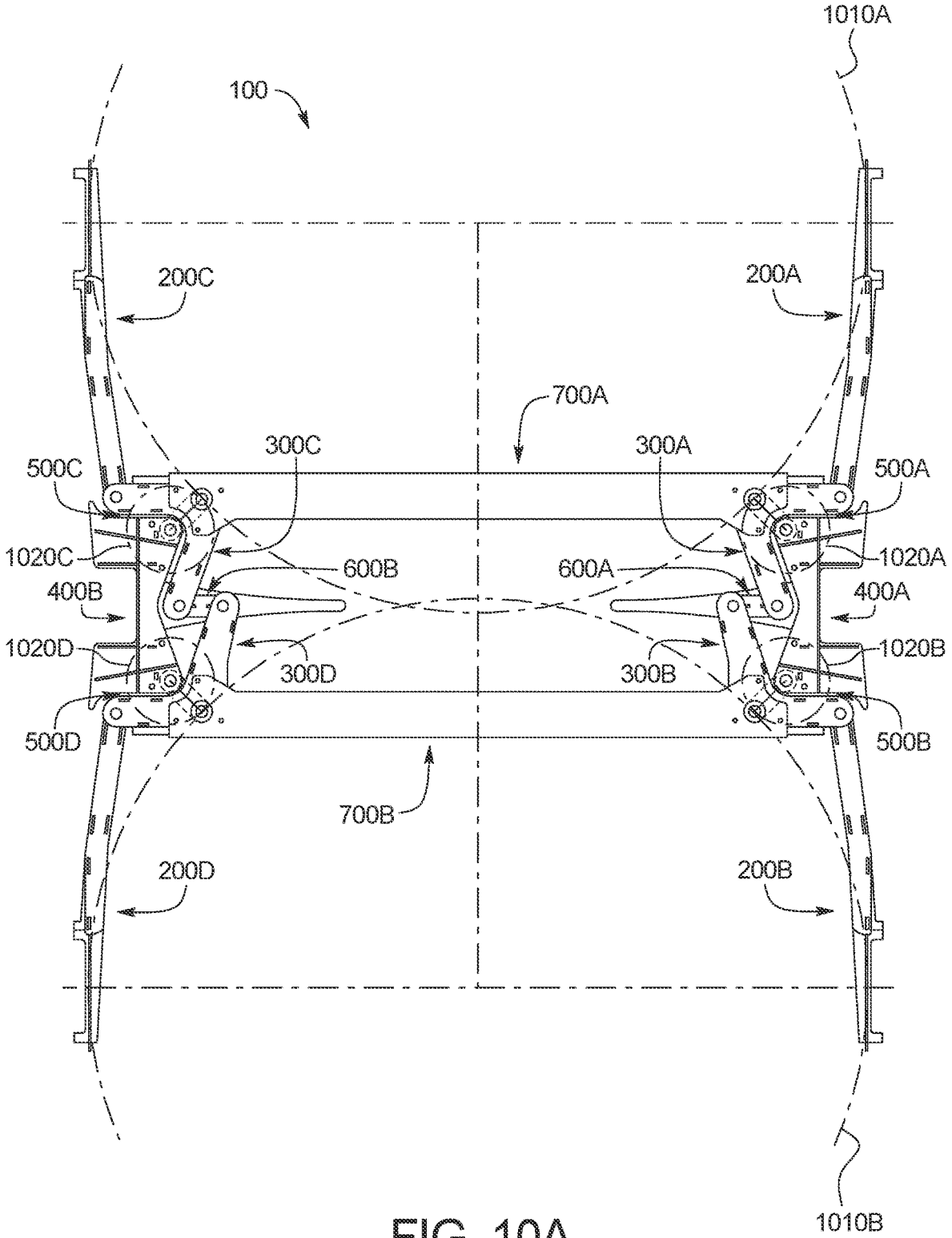
FIG. 10A is a top view of an example underslung steering assembly in a squared position, showing the arcs of movement of the wheels and pivotable short linkages.
Figure 10B:
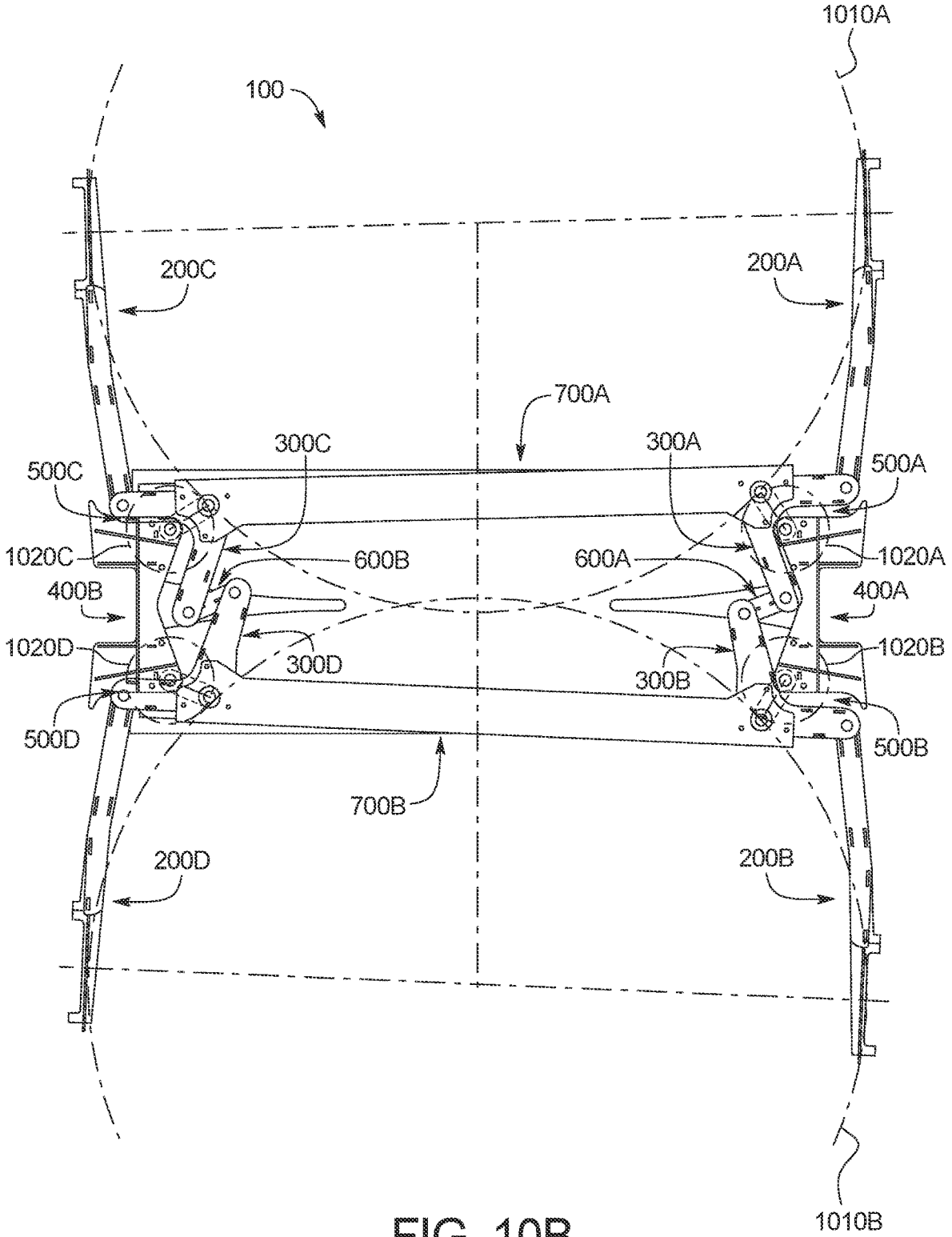
FIG. 10B is a top view of the underslung steering assembly of FIG. 10A shown without the transom, showing movement of the components of the underslung steering assembly when the right front wheel (top right as shown) has moved forward and the right rear wheel (bottom right as shown) has moved backward, and showing the arcs of movement of the wheels and pivotable short linkages. The Figures are drawn to scale, although other relative dimensions may be used, if desired, along with other modifications such as those described herein.

FIGS. 10A and 10B illustrate the same scenarios as are shown in FIGS. 9A and 9B. FIGS. 10A and 10B, however, illustrate the arc of movement of various components. Specifically, arc 1010A and 1010B illustrate the respective arcs of movement of the axles 34A and 34B. Arcs 1020A, 1020B, 1020C, and 1020D illustrate the respective arcs of movement of the pivotable short linkages 500A, 500B, 500C, and 500D.

As can be seen in FIG. 10B, the arc of movement of the axles 34A and 34B is tangent to the arc of movement of the pivotable short linkages 500A-D.

X. ADDITIONAL EMBODIMENTS

It should be appreciated that in various embodiments and in various circumstances, the underslung steering assembly 100 of the present disclosure may also act to provide other biasing forces to the side frames and/or may co-act with one or more other components of the car truck to provide other biasing forces to the side frames. These other biasing effects of the present disclosure can be considered as secondary potential biasing effects.

It should further be appreciated that the underslung steering assembly of the present disclosure requires adding relatively little additional material or weight to the car truck, and can be retrofitted onto many currently existing car trucks.

It should be appreciated that in various embodiments of the present disclosure, the underslung steering assembly does not need any lubrication.

It will be understood that modifications and variations may be effected without departing from the scope of the novel concepts of the present invention, and it is understood that this application is to be limited only by the scope of the claims.

It should be appreciated that the figures show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

For example, an aspect may include a car truck comprising a first side frame, a second side frame, and an underslung steering assembly connected to the first side frame and the second side frame. In another aspect, the underslung steering assembly includes a first side frame connection bracket connected to the first side frame, and a second side frame connection bracket connected to the second side frame. In any of the above aspects, the underslung steering assembly includes a first steering arm, a second steering arm, a third steering arm, and a fourth steering arm, wherein: the first steering arm and the second steering arm are coupled to the first side frame connection bracket, and the third steering arm and the fourth steering arm are coupled to the second side frame connection bracket. In any of the above aspects, the underslung steering assembly includes first, second, third, and fourth L shaped force transfer elbows, and wherein: the first steering arm is connected to the first L shaped force transfer elbow, the second steering arm is connected to the second L shaped force transfer elbow, the third steering arm is connected to the third L shaped force transfer elbow, and the fourth steering arm is connected to the fourth L shaped force transfer elbow. In any of the above aspects, the underslung steering assembly includes first, second, third, and fourth pivotable short linkages, and wherein: the first pivotable short linkage is connected to the first L shaped force transfer elbow and the first side frame connection bracket, the second pivotable short linkage is connected to the second L shaped force transfer elbow and the first side frame connection bracket, the third pivotable short linkage is connected to the third L shaped force transfer elbow and the second side frame connection bracket, and the fourth pivotable short linkage is connected to the fourth L shaped force transfer elbow and the first side frame connection bracket. In any of the above aspects the underslung steering assembly includes first and second lateral short linkages, and wherein: the first lateral short linkage is connected to the first L shaped force transfer elbow and the second L shaped force transfer elbow, and the second lateral short linkage is connected to the third L shaped force transfer elbow and the fourth L shaped force transfer elbow. In any of the above aspects the underslung steering assembly includes first and second transverse force transfer legs, and wherein: the first transverse force transfer leg is rigidly connected to the first L shaped force transfer elbow and the second L shaped force transfer elbow, and the second transverse force transfer leg is rigidly connected to the third L shaped force transfer elbow and the fourth L shaped force transfer elbow. In any of the above aspects, the underslung steering arm includes a transom rigidly connected to the first side frame connection bracket and the second side frame connection bracket. In any of the above aspects the underslung steering assembly includes: first, second, third, and fourth steering arms, first, second, third, and fourth L shaped force transfer elbows; first, second, third, and fourth pivotable short linkages; first and second lateral short linkages; first and second transverse force transfer legs; and a transom. In any of the above aspects the car includes first, second, third, and fourth bearing adapters, wherein the first, second, third, and fourth steering arms each include a bearing adapter connector coupled to a respective one of the first, second, third, and fourth bearing adapters. In any of the above aspects, the first, second, third, and fourth steering arms each include a force transfer elbow connector coupled to a respective one of the first, second, third, and fourth L shaped force transfer elbows. In any of the above aspects the first, second, third, and fourth steering arms each define an elbow connector aperture, through which fasteners are inserted to rotatably couple the first, second, third, and fourth steering arms to the first, second, third, and fourth L-shaped force transfer elbows respectively. In any of the above aspects the first, second, third, and fourth L shaped force transfer elbows each define a steering arm attachment aperture, a middle attachment aperture, and a lateral short linkage attachment aperture. In any of the above aspects the first, second, third, and fourth L shaped force transfer elbows are connected respectively to the first, second, third, and fourth steering arms; the first and second L-shaped force transfer elbows are connected to the first lateral short linkage; the third and fourth L-shaped force transfer elbows are connected to the second lateral short linkage; the first and third L-shaped force transfer elbows are connected to the first transverse force transfer leg; and the second and fourth L-shaped force transfer elbows are connected to the second transverse force transfer leg. In any of the above aspects the first side frame connection bracket is coupled to the first side frame; the first side frame connection bracket is coupled to the first pivotable short linkage; the first side frame connection bracket is coupled to the second pivotable short linkage; the second side frame connection bracket is coupled to the second side frame; the second side frame connection bracket is coupled to the third pivotable short linkage; and the second side frame connection bracket is coupled to the fourth pivotable short linkage. In any of the above aspects the first pivotable short linkage is coupled to the first side frame connection bracket and the first L shaped force transfer elbow; the second pivotable short linkage is coupled to the first side frame connection bracket and the second L shaped force transfer elbow; the third pivotable short linkage is coupled to the second side frame connection bracket and the third L shaped force transfer elbow; and the fourth pivotable short linkage is coupled to the second side frame connection bracket and the fourth L shaped force transfer elbow. In any of the above aspects the first lateral short linkage is coupled to the first L shaped force transfer elbow and the second L shaped force transfer elbow; and the second lateral short linkage is coupled to the third L shaped force transfer elbow and the fourth L shaped force transfer elbow. In any of the above aspects the first transverse force transfer leg is coupled to the first L shaped force transfer elbow and the third L shaped force transfer elbow; and the second transverse force transfer leg is coupled to the second L shaped force transfer elbow and the fourth L shaped force transfer elbow. In any of the above aspects the first transverse force transfer leg is rigidly coupled to the first L shaped force transfer elbow and the third L shaped force transfer elbow; and the second transverse force transfer leg is rigidly coupled to the second L shaped force transfer elbow and the fourth L shaped force transfer elbow. In any of the above aspects the transom is rigidly coupled to the first side frame connection bracket and the second side frame connection bracket.

Another aspect includes an underslung steering assembly for a car truck, the underslung steering assembly comprising: a first side frame connection bracket; a second side frame connection bracket; and a plurality of steering arms respectively coupled to either the first side frame connection bracket or the second side frame connection bracket. In any of the above aspects, the underslung steering assembly includes a plurality of L shaped force transfer elbows, wherein each of the plurality of L shaped force transfer elbows is connected to one of the plurality of steering arms. In any of the above aspects, the underslung steering assembly includes a plurality of pivotable short linkages, wherein each of the plurality of pivotable short linkages is connected to one of the plurality of L shaped force transfer elbows, and one of the first side frame connection bracket or the second side frame connection bracket. In any of the above aspects, the underslung steering assembly includes a plurality of lateral short linkages, wherein each of the plurality of lateral short linkages is connected to two of the plurality of L shaped force transfer elbows. In any of the above aspects, the underslung steering assembly includes a plurality of transverse force transfer legs, wherein each of the plurality of transverse force transfer legs is rigidly connected to two of the plurality of L shaped force transfer elbows. In any of the above aspects the underslung steering assembly includes a transom rigidly connected to the first side frame connection bracket and the second side frame connection bracket. In any of the above aspects, the underslung steering assembly includes a plurality of L shaped force transfer elbows; a plurality of pivotable short linkages; a plurality of lateral short linkages; a plurality of transverse force transfer legs; and a transom, wherein the underslung steering assembly is configured to bias wheels on a same side of the car truck to move in opposing directions from each other. In any of the above aspects, the each of the plurality of steering arms includes a bearing adapter connector couplable to a bearing adapter of the car truck, and a force transfer elbow connector couplable to a respective one of the plurality of L shaped force transfer elbows. In any of the above aspects each force transfer elbow connector is rotatably couplable to a respective one of the plurality of L shaped force transfer elbows. In any of the above aspects each of the plurality of L shaped force transfer elbows defines: a steering arm attachment aperture by which the L shaped force transfer elbow is coupled to a corresponding one of the plurality of steering arms; a middle attachment aperture by which the L shaped force transfer elbow is coupled to a corresponding one of the plurality of pivotable short linkages; and a lateral short linkage attachment aperture by which the L shaped force transfer elbow is coupled to a corresponding one of the plurality of lateral short linkages. In any of the above aspects the first side frame connection bracket defines: a first pivotable short linkage aperture by which the first side frame connection bracket is coupled to a first pivotable short linkage of the plurality of pivotable short linkages; and a second pivotable short linkage aperture by which the first side frame connection bracket is coupled to a second pivotable short linkage of the plurality of pivotable short linkages; and wherein the second side frame connection bracket defines: a third pivotable short linkage aperture by which the second side frame connection bracket is coupled to a third pivotable short linkage of the plurality of pivotable short linkages; and a fourth pivotable short linkage aperture by which the second side frame connection bracket is coupled to a fourth pivotable short linkage of the plurality of pivotable short linkages. In any of the above aspects each of the plurality of pivotable short linkages defines: a side frame connection bracket by which the pivotable short linkage is coupled to a respective one of the first side frame connection bracket or the second side frame connection bracket; and a force transfer elbow attachment aperture, by which the pivotable short linkage is coupled to a respective one of the plurality of L shaped force transfer elbows. In any of the above aspects the plurality of lateral short linkages includes a first lateral short linkage and a second elbow linkage, wherein the first lateral short linkage defines: a first force transfer elbow attachment aperture by which the first lateral short linkage is coupled to a first L shaped force transfer elbow of the plurality of L shaped force transfer elbows; and a second force transfer elbow attachment aperture by which the first lateral short linkage is coupled to a second L shaped force transfer elbow of the plurality of L shaped force transfer elbows; and wherein the second lateral short linkage defines: a third force transfer elbow attachment aperture by which the second lateral short linkage is coupled to a third L shaped force transfer elbow of the plurality of L shaped force transfer elbows; and a fourth force transfer elbow attachment aperture by which the second lateral short linkage is coupled to a fourth L shaped force transfer elbow of the plurality of L shaped force transfer elbows. In any of the above aspects the transom may define a plurality of side frame connection bracket attachment apertures, by which the transom is coupled to the first side frame connection bracket and the second side frame connection bracket.

The invention claimed is:

1. A car truck comprising:

a first side frame;

a second side frame; and an underslung steering assembly connected to the first side frame and the second side frame, wherein the underslung steering assembly includes:

first, second, third, and fourth steering arms;

first, second, third, and fourth L-shaped force transfer elbows;

first, second, third, and fourth pivotable short linkages;

first and second lateral short linkages;

first and second transverse force transfer legs; and a transom.

2. The car truck of claim 1, wherein the underslung steering assembly includes a first side frame connection bracket connected to the first side frame, and a second side frame connection bracket connected to the second side frame.

3. The car truck of claim 2, wherein the underslung steering assembly includes a first steering arm, a second steering arm, a third steering arm, and a fourth steering arm, wherein:

the first steering arm and the second steering arm are coupled to the first side frame connection bracket, and the third steering arm and the fourth steering arm are coupled to the second side frame connection bracket.

4. The car truck of claim 3, wherein the underslung steering assembly includes first, second, third, and fourth L-shaped force transfer elbows, and wherein:

the first steering arm is connected to the first L-shaped force transfer elbow, the second steering arm is connected to the second L-shaped force transfer elbow, the third steering arm is connected to the third L-shaped force transfer elbow, and the fourth steering arm is connected to the fourth L-shaped force transfer elbow.

5. The car truck of claim 2, wherein the underslung steering arm is connected to the transom rigidly connected to the first side frame connection bracket and the second side frame connection bracket.

6. The car truck of claim 1, which includes first, second, third, and fourth bearing adapters, wherein the first, second, third, and fourth steering arms each include a bearing adapter connector coupled to a respective one of the first, second, third, and fourth bearing adapters.

7. The car truck of claim 6, wherein the first, second, third, and fourth steering arms each include a force transfer elbow connector coupled to a respective one of the first, second, third, and fourth L-shaped force transfer elbows.

8. The car truck of claim 7, wherein the first, second, third, and fourth steering arms each define an elbow connector aperture, through which fasteners are inserted to rotatably couple the first, second, third, and fourth steering arms to the first, second, third, and fourth L-shaped force transfer elbows respectively.

9. The car truck of claim 1, wherein the first, second, third, and fourth L-shaped force transfer elbows each define a steering arm attachment aperture, a middle attachment aperture, and a lateral short linkage attachment aperture.

10. The car truck of claim 9, wherein:

the first, second, third, and fourth L-shaped force transfer elbows are connected respectively to the first, second, third, and fourth steering arms;

the first and second L-shaped force transfer elbows are connected to the first lateral short linkage;

the third and fourth L-shaped force transfer elbows are connected to the second lateral short linkage;

the first and third L-shaped force transfer elbows are connected to the first transverse force transfer leg; and the second and fourth L-shaped force transfer elbows are connected to the second transverse force transfer leg.

11. The car truck of claim 1, wherein:

the first side frame connection bracket is coupled to the first side frame;

the first side frame connection bracket is coupled to the first pivotable short linkage;

the first side frame connection bracket is coupled to the second pivotable short linkage;

the second side frame connection bracket is coupled to the second side frame;

the second side frame connection bracket is coupled to the third pivotable short linkage; and the second side frame connection bracket is coupled to the fourth pivotable short linkage.

12. The car truck of claim 1, wherein:

the first pivotable short linkage is coupled to the first side frame connection bracket and the first L-shaped force transfer elbow;

the second pivotable short linkage is coupled to the first side frame connection bracket and the second L-shaped force transfer elbow;

the third pivotable short linkage is coupled to the second side frame connection bracket and the third L-shaped force transfer elbow; and the fourth pivotable short linkage is coupled to the second side frame connection bracket and the fourth L-shaped force transfer elbow.

13. The car truck of claim 1, wherein:

the first lateral short linkage is coupled to the first L-shaped force transfer elbow and the second L-shaped force transfer elbow; and the second lateral short linkage is coupled to the third L-shaped force transfer elbow and the fourth L-shaped force transfer elbow.

14. The car truck of claim 1, wherein:

the first transverse force transfer leg is coupled to the first L-shaped force transfer elbow and the third L-shaped force transfer elbow; and the second transverse force transfer leg is coupled to the second L-shaped force transfer elbow and the fourth L-shaped force transfer elbow.

15. An underslung steering assembly for a car truck, the underslung steering assembly comprising:

a first side frame connection bracket;

a second side frame connection bracket;

a plurality of steering arms respectively coupled to either the first side frame connection bracket or the second side frame connection bracket;

a plurality of L-shaped force transfer elbows, wherein each of the plurality of L-shaped force transfer elbows is connected to one of the plurality of steering arms; and a plurality of transverse force transfer legs, wherein each of the plurality of transverse force transfer legs is rigidly connected to two of the plurality of L-shaped force transfer elbows.

16. The underslung steering assembly of claim 15, including a plurality of pivotable short linkages, wherein each of the plurality of pivotable short linkages is connected to one of the plurality of L-shaped force transfer elbows, and one of the first side frame connection bracket or the second side frame connection bracket.

17. The underslung steering assembly of claim 15, including a plurality of lateral short linkages, wherein each of the plurality of lateral short linkages is connected to two of the plurality of L-shaped force transfer elbows.

* * * * *